US012442369B2

(12) United States Patent
Zhu et al.

(10) Patent No.: US 12,442,369 B2
(45) Date of Patent: Oct. 14, 2025

(54) METHOD AND SYSTEM FOR LOAD CONTROL OF RECIPROCATING COMPRESSORS

(71) Applicant: Air Products and Chemicals, Inc., Allentown, PA (US)

(72) Inventors: Zhong-Xiang Zhu, Macungie, PA (US); David M. Espie, Lansdale, PA (US); Graeme Richard Wilson, Surrey (GB); Gregory W. Henzler, Emmaus, PA (US)

(73) Assignee: AIR PRODUCTS AND CHEMICALS, INC., Allentown, PA (US)

( * ) Notice: Subject to any disclaimer, the term of this patent is extended or adjusted under 35 U.S.C. 154(b) by 413 days.

(21) Appl. No.: 17/886,574

(22) Filed: Aug. 12, 2022

(65) Prior Publication Data

US 2024/0052827 A1 Feb. 15, 2024

(51) Int. Cl.
*F04B 49/16* (2006.01)
*F04B 41/06* (2006.01)
(Continued)

(52) U.S. Cl.
CPC ..... *F04B 49/16* (2013.01); *F04B 41/06* (2013.01); *F04B 49/03* (2013.01); *F04B 49/065* (2013.01);
(Continued)

(58) Field of Classification Search
CPC ..... F04B 49/16; F04B 41/06; F04B 49/03; F04B 49/065; F04B 2205/01;
(Continued)

(56) References Cited

U.S. PATENT DOCUMENTS

RE23,821 E * 5/1954 Davis ..... F25B 49/02 62/471
3,232,524 A * 2/1966 Rice ..... F04B 39/08 417/388
(Continued)

FOREIGN PATENT DOCUMENTS

CN 108599245 A 9/2018
CN 211040479 U 7/2020
(Continued)

OTHER PUBLICATIONS

EP Application No. 23 19 1141 European Search Report; Nov. 27, 2023.
(Continued)

*Primary Examiner* — Mark A Laurenzi
*Assistant Examiner* — Benjamin Doyle
(74) *Attorney, Agent, or Firm* — Matthew R. Weaver

(57) ABSTRACT

Controlling a capacity of the compression system in response to the variable incoming gas feed by: i) selectively varying a capacity of a first subset of one or more of the compressor trains by continuously varying the capacity of one or more cylinders of the one or more reciprocating compressor stages of the one or more compressor trains of the first subset between a maximum capacity and a minimum capacity; and/or ii) selectively varying a capacity of a second subset of one or more of the compressor trains by fully loading or fully unloading one or more cylinders of the one or more reciprocating compressor stages of the compressor trains of the second subset, wherein the first and second subsets are mutually exclusive.

18 Claims, 8 Drawing Sheets

(51) Int. Cl.
*F04B 49/03* (2006.01)
*F04B 49/06* (2006.01)

(52) U.S. Cl.
CPC ..... *F04B 2205/01* (2013.01); *F04B 2205/09* (2013.01)

(58) Field of Classification Search
CPC .. F04B 2205/09; F04B 49/007; F04B 49/035; F04B 49/22; F04B 49/02; F04B 49/12; F04B 49/20
USPC ..... 417/244–268, 274, 44.2, 44.3
See application file for complete search history.

(56) References Cited

U.S. PATENT DOCUMENTS 3,487,657 A 1/1970 Teegarden
4,330,237 A * 5/1982 Battah ..... F02B 63/06 417/42
4,432,705 A * 2/1984 Fraser ..... F04B 49/225 417/295
4,618,310 A * 10/1986 Michelson ..... F04D 17/12 415/129
4,787,211 A * 11/1988 Shaw ..... F25B 41/20 417/248
4,825,380 A * 4/1989 Hobbs ..... F04D 27/0207 700/282
4,971,516 A * 11/1990 Lawless ..... F04D 27/0207 415/17
5,743,715 A 4/1998 Staroselsky et al.
6,695,591 B2 * 2/2004 Grimmer ..... F04D 27/00 417/252
7,444,189 B1 10/2008 Marhoefer
2008/0307812 A1 * 12/2008 Hirota ..... F04B 27/1804 62/228.3
2013/0139535 A1 * 6/2013 Nares ..... F04B 39/10 137/565.11
2013/0177393 A1 7/2013 Sishtla et al.
2014/0079593 A1 3/2014 Naito et al.
2014/0350735 A1 * 11/2014 Zhang ..... G05D 7/0617 700/282
2015/0147193 A1 * 5/2015 Grassens ..... F04D 27/002 700/282
2016/0326958 A1 * 11/2016 Kosamana ..... F02C 6/16
2017/0122129 A1 5/2017 Heid et al.
2017/0145915 A1 5/2017 Heid et al.
2017/0317502 A1 11/2017 Ito
2019/0003425 A1 * 1/2019 Pages ..... F25J 1/0025
2021/0071815 A1 * 3/2021 Ragot ..... F17C 13/004
2022/0033983 A1 * 2/2022 Higginbotham ..... C25B 15/02

FOREIGN PATENT DOCUMENTS

CN 112086960 A 12/2020
EP 3193017 A1 7/2017
JP 2018207728 A 12/2018
JP 2022066059 A 4/2022
WO 2016170700 A1 10/2016

OTHER PUBLICATIONS

EP Application No. 23 19 1140 European Search Report; Jan. 24, 2024.
Siddiqui O, Ishaq H, Chehade G, Dincer I. Performance investigation of a new renewable energy-based carbon dioxide capturing system with aqueous ammonia; Int J Energy Res. 2020;44:2252-2263; (12 pgs.) Nov. 30, 2019.
Guerra, C. Fúnez, et al; Technical-economic analysis for a green ammonia production plant in Chile and its subsequent transport to Japan; Renewable Energy 157 (2020) 404-414; (11 pgs.) May 9, 2020.
Palys, Matthew J. and Dautidis, Prodromos; "Using hydrogen and ammonia for renewable energy storage: A geographically comprehensive techno-economic study"; Computers and Chemical Engineering 136 (2020) 106785; (13 pgs.) Feb. 23, 2020.
Ishaq, H., Dincer, I.; Design and simulation of a new cascaded ammonia synthesis system driven by renewables; Sustainable Energy Technologies and Assessments 40 (2020) 100725; (14 pgs.) May 6, 2020.
Ozturk M, Dincer I., An integrated system for ammonia production from renewable hydrogen: A case study, International Journal of Hydrogen Energy; (8 pgs.) https://doi.org/10.1016/j.ijhydene.2019.12.127.
Nayak-Luke, Richard, et al; "Green" Ammonia: Impact of Renewable Energy Intermittency on Plant Sizing and Levelized Cost of Ammonia; (10 pgs.) Ind. Eng. Chem. Res. 2018, 57, 14607-14616.
"K-GreeN-Digital-Solutions", Kellogg, Brown & Root LLC; Jan. 2021, 17 pgs.

* cited by examiner

METHOD AND SYSTEM FOR LOAD CONTROL OF RECIPROCATING COMPRESSORS

TECHNICAL FIELD

The present invention relates to a method and system for load control of reciprocating compressors. More particularly, the present invention relates to a method and system for load control of reciprocating compressors in production and storage of one or more industrial gases in an industrial gas production complex having a variable input power resource such as a renewable power source.

BACKGROUND

An industrial gas plant complex may comprise one or more process plants which produce, or are involved in the production of, gases. In non-limiting examples, these gases may comprise: industrial gases, commercial gases, medical gases, inorganic gases, organic gases, fuel gases and green fuel gases either in gaseous, liquified or compressed form.

There is considerable interest in methods and systems for utilising renewable energy sources for powering industrial gas plants and industrial gas plant complexes. However, a significant drawback of the use of renewable energy sources such as wind, solar and tidal power is the natural variability and transient nature of such energy sources.

In general, a constant or substantially constant power supply is preferred for an industrial gas plant or industrial gas plant complex. This enables processes within the industrial gas plant complex to be run at substantially constant and optimal rates for one or more processes within the industrial plant complex.

Consequently, the variable and intermittent nature of renewable power sources (for example, wind, solar and/or tidal power) is problematic for operation of industrial gas plants. Incoming power variations, if poorly managed, can result in power shortages which may lead to inefficient operation rates and/or shutdowns of various processes. These can be costly in terms of time, expenditure, gas production and lost opportunity.

However, even if power is managed effectively, the variations in available power will result in an industrial gas plant operated on renewable sources intrinsically having a much greater range of operation and production rates than industrial gas plants powered by more conventional means.

For many industrial gases, it is necessary to compress the industrial gas to a desired pressure for onward transportation and use, or for on-site storage. However, the greater range of operational conditions and production pressures resulting from the use of renewable power sources can present a significant challenge for the stable and efficient operation of compressor systems.

To date, known control arrangements for compression systems are unsuitable for efficient and reliable management of compressors subject to wide variations in production feed rates and/or pressures. Thus, solutions to these technical problems are required to enable industrial gases to be compressed efficiently and stably in such arrangements.

Therefore, there exists a need in the art to provide more effective management of gas compression in a compressor arrangement.

BRIEF SUMMARY OF THE INVENTION

The following introduces a selection of concepts in a simplified form in order to provide a foundational understanding of some aspects of the present disclosure. The following is not an extensive overview of the disclosure, and is not intended to identify key or critical elements of the disclosure or to delineate the scope of the disclosure. The following merely summarizes some of the concepts of the disclosure as a prelude to the more detailed description provided thereafter.

According to a first aspect of the present invention, there is provided a process for operating a compression system configured to compress a variable incoming gas feed, the compression system comprising a plurality of parallel compressor trains, each compressor train comprising one or more reciprocating compressor stages each having one or more cylinders, the process comprising: controlling a capacity of the compression system in response to the variable incoming gas feed by: i) selectively varying a capacity of a first subset of one or more of the compressor trains by continuously varying the capacity of one or more cylinders of the one or more reciprocating compressor stages of the one or more compressor trains of the first subset between a maximum capacity and a minimum capacity; and/or ii) selectively varying a capacity of a second subset of one or more of the compressor trains by fully loading or fully unloading one or more cylinders of the one or more reciprocating compressor stages of the compressor trains of the second subset; wherein the first and second subsets are mutually exclusive.

In one embodiment, the capacity of the compression system is varied in response to the pressure of the incoming gas feed, and the process further comprises: determining the gas pressure of the incoming gas feed.

In one embodiment, varying the capacity of the first subset of the compressor trains comprises varying the capacity of each cylinder of each reciprocating compressor stage of the compressor trains forming the first subset simultaneously and by the same amount.

In one embodiment, each of the one or more cylinders of the one or more reciprocating compressor stages of the one or more compressor trains of the first subset comprises a suction unloader valve to continuously vary the capacity thereof.

In one embodiment, varying the capacity of the second subset of the compressor trains comprises fully loading or fully unloading one cylinder from each reciprocating compressor stage of the compressor trains of the second subset at a time.

In one embodiment, each compressor train comprises the same number (n) of compressor stages, where $n>1$.

In one embodiment, each reciprocating compressor stage comprises a plurality of cylinders.

In one embodiment, each reciprocating compressor stage has the same number of cylinders.

In one embodiment, the step of controlling the capacity of the compression system comprises: a) during periods when the incoming gas feed is received by the compression system at a flow between a total maximum capacity of the plurality of compressor trains and a first threshold capacity lower than the total maximum capacity, continuously varying the capacity of the first subset of one or more compressor trains in response to the change in flow of the incoming gas feed.

In one embodiment, the step of controlling the capacity of the compression system further comprises: b) during periods when the incoming gas feed is received by the compression system at a flow between the first threshold capacity of the plurality of compressor trains and a second threshold capacity lower than the first threshold capacity, fully unloading one or more first loaded cylinders of the second subset of one or more compressor trains in response to the flow of the incoming gas feed reducing by an amount equal to the capacity of the one or more first cylinders, or fully loading one or more first unloaded cylinders of the second subset of one or more compressor trains in response to the flow of the incoming gas feed increasing by an amount equal to the capacity of the one or more first cylinders.

In one embodiment, step b) further comprises: c) in response to the full unloading of one or more first loaded cylinders of the second subset, simultaneously increasing the capacity of the first subset of one or more compressor trains by an amount equal to the capacity of the said one or more first cylinders or in response to the full loading of one or more first unloaded cylinders of the second subset, simultaneously decreasing the capacity of the first subset of one or more compressor trains by an amount equal to the capacity of the said one or more first cylinders.

In one embodiment, the process further comprises repeating step b) for one or more further cylinders of the second subset.

In one embodiment, step b) is repeated until only a single cylinder in each reciprocating compressor stage of each train of the second subset remains.

In one embodiment, the step of controlling the capacity of the compression system further comprises: d) during periods when the incoming gas feed is received by the compression system at a flow between the second threshold capacity and a total minimum capacity, continuously varying the capacity of the first subset of one or more compressor trains in response to the change in flow of the incoming gas feed.

In one embodiment, each compressor train comprises a local recycle valve connected between an outlet from the compressor train and an inlet to the compressor train, and the step of controlling the capacity of the compression system further comprises: e) during when the incoming gas feed is received by the compression system at a flow which is at or below the total minimum capacity, operating the local recycle valve of each compressor train to recycling gas from the outlet of each compressor train to the inlet of each compressor train.

According to a second aspect of the present invention, there is provided a control system for operating a compression system configured to compress a variable incoming gas feed, the compression system comprising a plurality of parallel compressor trains, each compressor train comprising one or more reciprocating compressor stages each having one or more cylinders, the control system being configured to control a capacity of the compression system in response to the variable incoming gas feed by: i) selectively varying a capacity of a first subset of one or more of the compressor trains by continuously varying the capacity of one or more cylinders of the one or more reciprocating compressor stages of the one or more compressor trains of the first subset between a maximum capacity and a minimum capacity; and/or ii) selectively varying a capacity of a second subset of one or more of the compressor trains by fully loading or fully unloading one or more cylinders of the one or more reciprocating compressor stages of the compressor trains of the second subset; wherein the first and second subsets are mutually exclusive.

In one embodiment, varying the capacity of the first subset of the compressor trains comprises varying the capacity of each cylinder of each reciprocating compressor stage of the compressor trains forming the first subset simultaneously and by the same amount.

In one embodiment, each of the one or more cylinders of the one or more reciprocating compressor stages of the one or more compressor trains of the first subset comprises a suction unloader valve to continuously vary the capacity thereof.

In one embodiment, varying the capacity of the second subset of the compressor trains comprises fully loading or fully unloading one cylinder from each reciprocating compressor stage of the compressor trains of the second subset at a time.

According to a third aspect of the present invention, there is provided a computer readable storage medium storing a program of instructions executable by a machine to perform a process for operating a compression system configured to compress a variable incoming gas feed, the compression system comprising a plurality of parallel compressor trains, each compressor train comprising one or more reciprocating compressor stages each having one or more cylinders, the process comprising: controlling a capacity of the compression system in response to the variable incoming gas feed by: i) selectively varying a capacity of a first subset of one or more of the compressor trains by continuously varying the capacity of one or more cylinders of the one or more reciprocating compressor stages of the one or more compressor trains of the first subset between a maximum capacity and a minimum capacity; and/or ii) selectively varying a capacity of a second subset of one or more of the compressor trains by fully loading or fully unloading one or more cylinders of the one or more reciprocating compressor stages of the compressor trains of the second subset; wherein the first and second subsets are mutually exclusive.

BRIEF DESCRIPTION OF THE DRAWINGS

Embodiments of the present invention will now be described by example only and with reference to the figures in which:

FIG. 9 is an example of an industrial gas plant which the present invention is suitable for use as a part of.

Embodiments of the present disclosure and their advantages are best understood by referring to the detailed description that follows. It should be appreciated that like reference numbers are used to identify like elements illustrated in one or more of the figures, wherein showings therein are for purposes of illustrating embodiments of the present disclosure and not for purposes of limiting the same.

DETAILED DESCRIPTION

Various examples and embodiments of the present disclosure will now be described. The following description provides specific details for a thorough understanding and enabling description of these examples. One of ordinary skill in the relevant art will understand, however, that one or more embodiments described herein may be practiced without many of these details. Likewise, one skilled in the relevant art will also understand that one or more embodiments of the present disclosure can include other features and/or functions not described in detail herein. Additionally, some well-known structures or functions may not be shown or described in detail below, so as to avoid unnecessarily obscuring the relevant description.

In embodiments, the disclosure relates to load control of compressors for compressing gas produced at least in part using renewable power. The compressors may take the form of reciprocal compressors. The gas to be compressed may take any suitable form. However, in embodiments, the gas is Hydrogen.

Gas Production, Compression and Storage System Overview

Figure 1:
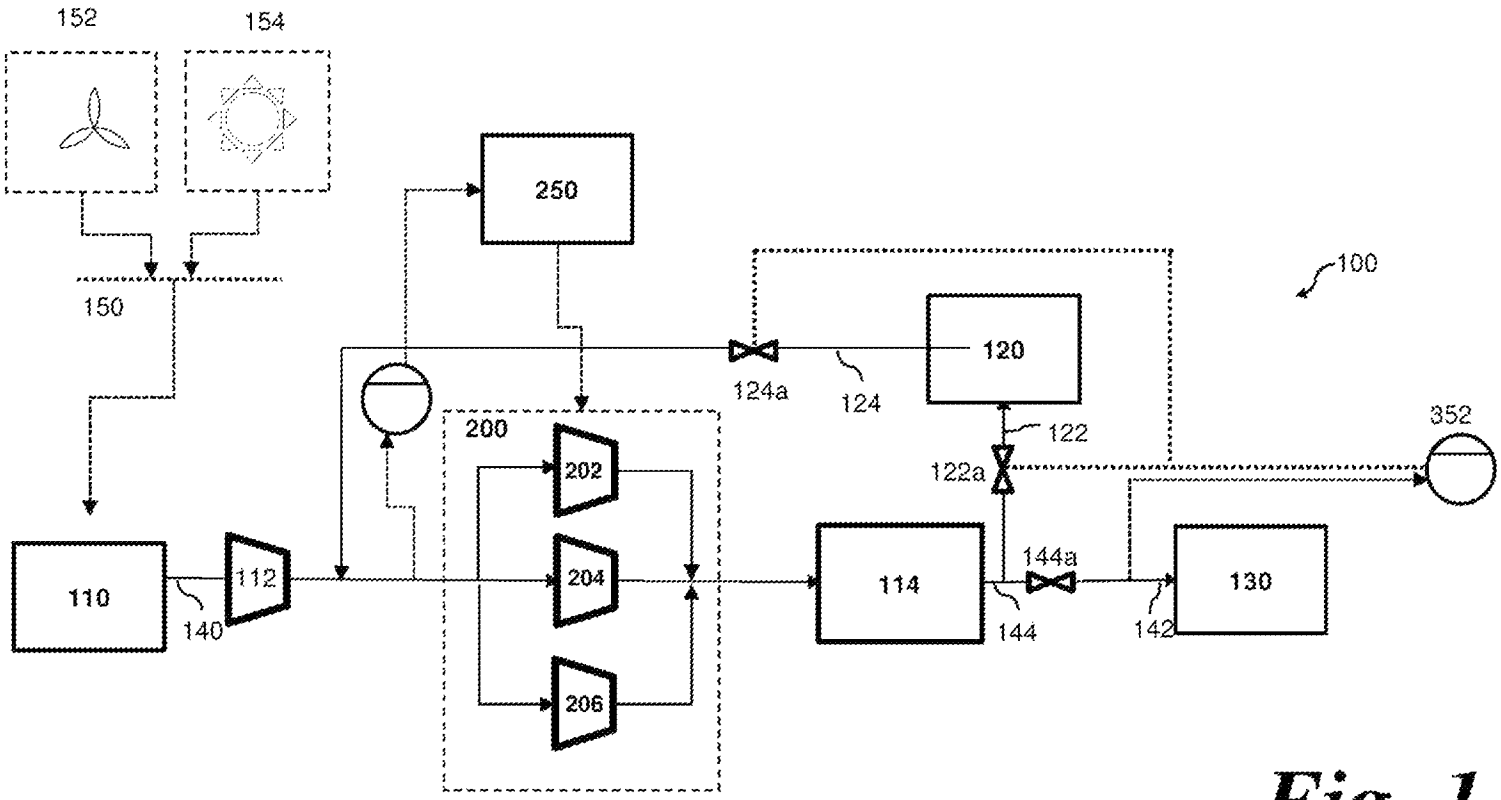
FIG. 1 is a schematic diagram of a production and storage facility for producing and supplying a feedstock gas according to an embodiment.

FIG. 1 shows an exemplary schematic of a gas production and storage system 100 incorporating a compression system 200 having a controller 250 according to an embodiment.

The production and storage system 100 comprises an industrial gas production facility 110 and a gas storage resource 120. The industrial gas production facility 110 is arranged to produce industrial gas for use in a downstream process unit 130. The industrial gas production facility 110 may comprise a Hydrogen production plant or an ASU as discussed above. Alternatively, the industrial gas production facility 110 may comprise any suitable gas production facility. The skilled person would be readily aware of the types of facility that could be used in the present embodiment.

Electricity for the production and storage system 100 as a whole may be supplied from a bus 150. However, in the context of the present embodiment, the supply of electricity from the bus 150 to the industrial gas production facility 110 is a key consideration.

In embodiments, the electricity provided from the bus 150 is generated from at least one renewable energy source which may comprise wind energy 152 (via a suitable wind farm comprising a plurality of wind turbines) and/or solar energy 154 (via a solar farm comprising a plurality of solar cells). However, this is not intended to be limiting and other renewable energy sources may be used such as hydroelectric (not shown) and/or tidal power (not shown).

The intrinsic time-dependent variation in power supplied to the bus 150 by the renewable energy sources 152, 154 presents challenges in the efficient and smooth operation of the production and storage system 100.

For example, on a typical summer's day solar power availability is high for a significant proportion of the day. Wind power availability is also high. Therefore, power generated from renewable sources may maintain a generally constant baseline and a high peak early in a given day. In such a situation the supplied electricity is plentiful and the operation of the gas production and storage system 100 is not power-limited and is restricted only by the peak or optimal operating criteria for the components of the gas production and storage system 100.

However, on a typical winter day in which sunlight and wind levels are lower, generated power from the renewable sources 152, 154 to the bus 150 may be at or close to zero during the night and reaches a relatively smaller peak during the middle of the day. Whilst techniques such as short-term energy storage (for example battery energy storage systems (BESS)) could be used to compensate for short term power availability reductions, it is not practically possible to meet the full power demands of the gas production and storage system 100 across the entire time period where renewable energy is at a minimum.

As a result, it is practically necessary to vary the production rate of the various plants in response to the available power. In turn, this means that compression stages for compressing gas produced in those plants need to be able to handle significant variations in the input gas feed. It is also necessary to manage operation of the compressors in order to reduce power consumption thereof.

The described embodiment is applicable to a wide range of gas production and/or storage configurations. For example, whilst the embodiment is described in relation to a gas production facility, this need not be the case and pre-produced gas may be supplied at a variable pressure from another source. Alternatively, the gas storage need not be present, or may be located elsewhere.

Any suitable downstream process unit 130 may be used which utilises the produced gas as a feedstock. Examples of suitable downstream process units 130 may include an oil refinery, a steel manufacturing facility, an ammonia synthesis plant or a Hydrogen liquefaction plant as described below. In some embodiments, a plurality of downstream process units 130 may be used in parallel.

The downstream process may comprise a single process or a plurality of downstream processes arranged in parallel. In embodiments where the produced gas comprises Hydrogen gas, the downstream process(es) could include any process that may use "grey" or "blue" Hydrogen, for example: steel manufacture and oil refinery operations.

In preferred embodiments, at least some or all of the produced gas is Hydrogen gas used to produce ammonia as described in embodiments below.

In alternative embodiments, the produced Hydrogen gas may be used to produce methanol via, for example, $CO_2$ hydrogenation. In other alternative embodiments, the produced Hydrogen gas may be liquefied by cryogenic cooling.

The above downstream processes are examples and are not intended to be limiting. Further, any suitable combinations of the above examples may be used together, with a proportion of the produced gas going to one downstream process and the other proportion being sent to a different downstream process (e.g. if the produced gas is Hydrogen, the downstream processes may comprise part Ammonia production and part liquification by cryogenic cooling).

A supply feed line 140 extends from an output header of the gas production facility 110 to a supply outlet 142 in fluid communication with the downstream process unit 130.

A first Low Pressure (LP) compression system 112 is provided downstream of the supply outlet. The low pressure (LP) compression system 112 is operable to compress the produced gas from a first feed pressure from the production facility to a second intermediate pressure greater than the first feed pressure. The LP compression system 112 may, in embodiments, comprise one or more centrifugal compressors. Centrifugal compressors are well suited to handling large gas volumes at relatively low compression rates.

However, the discharge pressure from a centrifugal compressor may vary depending upon the input pressure from the production facility 110 and/or the molecular weight of the gas.

A compression system 200 is located in the flow path along supply feed line 140 downstream of the LP compression system 112. In embodiments, the compression system 200 may comprise a medium pressure (MP) compression system.

The compression system 200 comprises three compression trains 202, 204, 206 arranged in parallel. Although shown as a single unit in FIG. 1, in embodiments, each compression train 202, 204, 206 comprises, in non-limiting embodiments, three stages. A controller 250 is arranged to control operation of the compression trains 202, 204, 206 as will be described below with reference to FIGS. 2 and 3.

The controller 250 further comprises pressure indicator controller (PIC) 252 operable to measure the pressure of gas $P_1$ downstream of the LP compression system 200 in the inlet header to the compression system 200.

Downstream of the compression system 200 is a purification section 114. The purification section 114 may not be required depending upon the industrial gas in question. However, if the gas in question is Hydrogen, then the purification section 114 may comprise a "DeOxo" unit in which oxygen is removed by the catalytic combustion of Hydrogen to produce water and oxygen-depleted compressed Hydrogen gas, which may then be dried in a drier such as an adsorption unit, for example, a temperature swing adsorption (TSA) unit.

A discharge header 144 of the supply feed line 140 is located downstream of the purification section 114 and comprises a control valve 144*a* to control the flow of gas to the downstream process unit 130.

The gas storage resource 120 may comprise pressure vessels and/or pipe segments connected to a common inlet header and a common outlet header. The pressure vessels may be spheres, for example, to about 25 m in diameter, or "bullets" which are horizontal vessels with large L/D ratios (typically up to about 12:1) with diameters up to about 12 m. In certain geographies, underground caverns may be included as storage systems to flatten out the seasonal variations associated with the renewable power.

The gas storage resource 120 is arranged in a parallel feed loop with the compression system 200 and purification section 114. An inlet feed line 122 extends from the supply feed line 140 downstream of the discharge header 144 to the inlet header of the gas storage 120. A control valve 122*a* is located in the inlet feed line 122 to control flow of gas into the gas storage resource 120.

An outlet return feed line 124 extends from the outlet header of the gas storage resource 120 to the supply feed line 140 upstream of an inlet header of the compression section 114. Flow from the gas storage resource 120 is controlled by control valve 124*a* which selectively enables gas from storage to be fed back into the supply feed line 140 and into the compression system 200 and purification section 114 via return line 124.

In this arrangement, compressed and purified gas can be directed seamlessly and as appropriate from either storage or from production to the downstream process unit 130. Alternatively, gas which has been produced above demand from the downstream process unit 130 can be sent direct to the gas storage 120 for later use.

The compression system 200 will now be described with particular reference to FIGS. 2 and 3.

Compression System 200 Introduction

The compression system 200 is operable to compress a gas feed having a variable flow. In embodiments as described, such a gas is produced using electricity generated at least in part from renewable energy sources.

The purpose of a compression system is to receive an input gas at a feed pressure (i.e. pressure at which the gas is generated) and compress that gas to an elevated pressure. The pressure will in general be determined by the requirements of the downstream processes 130, such that the elevated pressure will be equal to or greater than the feed pressure of said downstream process(es). In embodiments, the compression system 200 is operable to compress further gas received from the LP compression system 112 for use by downstream process(es) 130.

Operation of the compression system 200 is determined at least in part by gas produced using electricity from a renewable energy source. In embodiments, this may comprise Hydrogen gas produced by one or more electrolysers as described above and below.

In general, considerably more power is required to operate the gas production facility 100 than to operate the compression system 200. In conditions where little or no gas is supplied from the gas production facility then, as described above, gas flow may temporarily be provided by gas stored in the gas storage resource 120 with the aim of meeting or maintaining a predefined supply pressure to the downstream processes 130 (although the mass flow rate may of course vary).

However, even under these conditions of additional supply from the storage resource 120, the flow of gas into the compression system 200 may vary considerably in use. The compression system 200 must, in embodiments, be adaptable to address this variability.

In addition, an aim of an industrial process plant powered by renewable sources may be to reduce or mitigate environmental impact. As a result, there exists a drive to reduce power consumption of operational components of the industrial gas production plant as a whole. This includes the compression system 200. Thus, in situations where the full capacity of the compression system 200 is not required, techniques to reduce the power by the compression system 200 assist in achieving the overall aims of an industrial production plant run on renewable energy resources.

Compression System 200 Components

Figure 2:
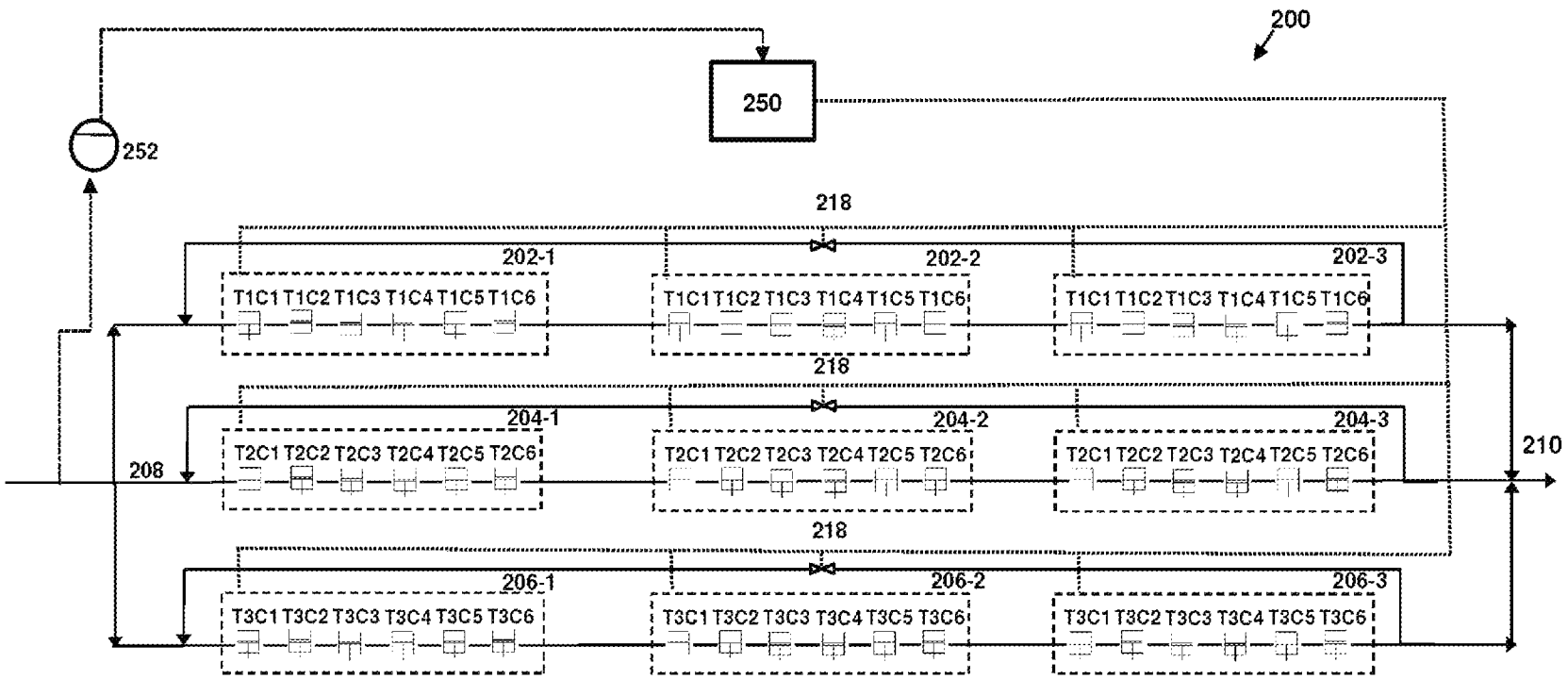
FIG. 2 is a schematic diagram of a compression system according to an embodiment.
Figure 3:
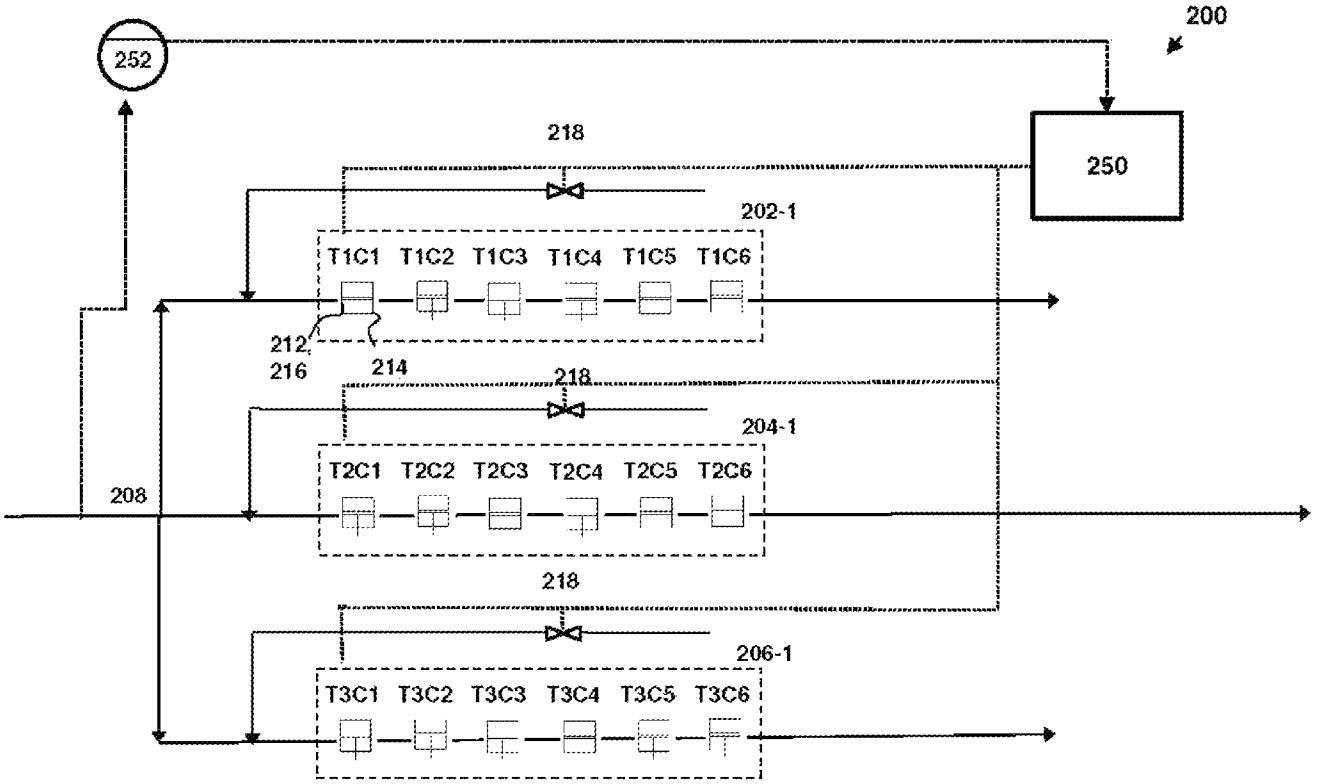
FIG. 3 is a magnified schematic diagram of a part of the compression system of FIG. 2 according to an embodiment.

With reference to FIGS. 2 and 3, in embodiments, the compression system 200 comprises three parallel compression trains 202, 204, 206. However, this is non-limiting and the number of parallel compression trains n may take any value provided n>1. In other words, at least two parallel compression trains are required.

In embodiments, the compression trains 202, 204, 206 each comprise three stages 202-1, 202-2, 202-3; 204-1, 204-2, 204-3; 206-1, 206-2, 206-3 (FIG. 2) arranged in series within the train. However, this need not be the case and any positive integer number of stages could be used with the present invention.

In embodiments, each stage 202-1, 202-2, 202-3; 204-1, 204-2, 204-3; 206-1, 206-2, 206-3 comprises one or more reciprocating compressors. Reciprocating compressors are positive displacement devices where a reciprocating piston within a cylinder is used as a compression and positive displacement element in order to reduce the volume of a gas within the cylinder and concomitantly increase its pressure.

Each cylinder is closed by a cylinder head at a first end and by the piston at a second end. A suction inlet and a discharge outlet are provided. Both the suction inlet and discharge outlets comprise movable valves.

In use, gas is drawn through the suction inlet (when the suction inlet valve is in an open position) during an expansion phase (i.e. where the piston is moving away from the first end expanding the volume of the cylinder). When the piston motion reverses, the inlet valve is closed and a compression phase takes place within the cylinder. When the cylinder pressure exceeds a predetermined pressure, the discharge outlet valve is opened and the pressurised gas is passed downstream into the discharge outlet.

The term "reciprocating compressor" in this disclosure is intended to cover all suitable forms and configurations of this class of compressor. For example, a reciprocating compressor may comprise a separable compressor where the compressor cylinder and piston arrangement is separate from its driving mechanism (such as an engine or electric motor) and, commonly, connected thereto by a gearbox.

Alternatively, a reciprocating compressor may comprise an integrated compressor where the power source for the compressor is mounted within the same frame as the cylinder and piston compression units. A plurality of compressor cylinders may be located within the same frame.

The reciprocating compressor may also comprise single acting cylinders or double acting cylinders. Single acting cylinders comprise only compress gas in a single direction of travel. Double acting cylinders compress gas in both directions of travel in an alternate manner at different ends of the cylinder.

Practically speaking, a double acting cylinder can be considered functionally equivalent to two integrated single acting cylinders. For example, one end of a double acting cylinder can be unloaded without compromising the performance of the other end. Thus, a "cylinder" as described herein may comprise one cylinder of a double acting cylinder or it may comprise a single acting cylinder, or any suitable variation.

As a further alternative, the reciprocating compressor may take the form of a diaphragm compressor where a piston moves a diaphragm to change the volume of the cylinder rather than moving within the cylinder itself.

There is no limit on the number of cylinders within each reciprocating compressor train, the number of stages within each train or to the number of parallel trains. However, in embodiments, the number of trains is three, each train has three compression stages and each compression stage has six cylinders.

The use of reciprocating compressors in a Medium Pressure (MP) train downstream of a LP train has numerous advantages. For example, a reciprocating compressor is operable by its structure and operation to deliver a fixed discharge pressure which, unlike centrifugal compressors, is unaffected by changes in molecular weight of the gas being compressed. This means that, in general, higher compression ratios can be achieved in fewer stages.

FIGS. 2 and 3 show the compression system 200 in more detail. FIG. 2 shows a detailed view showing the three parallel trains 202, 204, 206 each comprising three stages -1, -2, -3 respectively. FIG. 3 shows a more detailed view of only the single stage 202-1, 204-1, 206-1 of each train.

As shown in FIG. 2, each train 202, 204, 206 is connected to a common inlet header 208 from the gas production facility 110. Each reciprocating compressor train 202, 204, 206 comprises three stages -1, -2, -3 respectively, each stage having six sets of cylinders T1C1-T1C6; T2C1-T2C6; T3C1-T3C6. The parallel trains 202, 204, 206 share a common discharge header 210. Note that FIG. 2 is purely schematic of the components of each of the trains 202, 204, 206 and is not intended to be illustrative of any structural or flow connections.

Each cylinder T1C1-T1C6; T2C1-T2C6; T3C1-T3C6 of each stage has a suction inlet having a suction inlet valve 212 (this is shown in FIG. 3 in relation to a single cylinder for clarity however this feature is present on all cylinders) connected to an inlet supply and a discharge outlet and discharge outlet valve 214 (this is shown in FIG. 3 in relation to a single cylinder for clarity however this feature is present on all cylinders) connected to a discharge pipe. The suction inlet valve 212 and suction inlet may, in the case of a single acting cylinder, be formed at the same end of the cylinder as the discharge outlet.

The suction inlets 212 of the cylinders T1C1-T1C6 of the three stages 202-1, 202-2, 202-3 of the first train 202 are each provided with a suction valve unloader 216. The suction valve unloader 216 is operable to prevent the closing of the suction inlet valve 212. Through precise control and adjustment, the suction valve unloader 216 can be modified to control the volume of gas that will be compressed in each compression cycle. This will be described below in more detail.

If the reciprocating compressor comprises a double acting cylinder, there may be a suction inlet either side of the piston, and discharge outlets also on either side of the piston and on an opposing side of the cylinder from the inlets. The two inlets may be connected via a common plenum upstream thereof and outlets may be connected via a common plenum downstream thereof and upstream of the discharge pipe.

The compressor further comprises an intercooler downstream of the outlet. For brevity, this is not shown. When downstream of the compression stage, this is known as an "aftercooler". In a "multistage" compression system, a plurality of stages of compression occurs between compressors arranged in parallel and/or in series. The overall pressure ratio across each stage may generally in the range of about 1.5 to about 2.5 in order to limit the increase in temperature of the compressed gas.

The intercooler is then required between adjacent stages or at the end of a stage to remove thermal energy from the compression of the gas. The intercooler may take the form of any suitable cooling apparatus; for example, a heat exchanger.

In addition, phase separators may also be located upstream of each stage of compression to remove liquid water and, in embodiments, this may be combined with the intercooler as a single unit to simplify the structure. The intercooler is part of the compression apparatus and it is usual to define the discharge pressure as the pressure at the discharge flange of the aftercooler.

Each reciprocal compressor train 202, 204, 206 also has an associated local recycle system controlled by a respective valve 218. The local recycle system removes compressed gas from the discharge outlet and, after suitable pressure reduction in valve 218, feeds the gas back to the suction inlet 212 for recycling.

Referring back to FIG. 2, as shown each train 202, 204, 206 comprises three stages -1, -2, -3 each having six sets of cylinders T1C1-T1C6; T2C1-T2C6; T3C1-T3C6. The control arrangement for operation of the trains 202, 204, 206 and the cylinders therein will now be described.

Compressor Control Arrangement

The compressor system 200 comprises the control arrangement 250 and Pressure Indicator Controller (PIC) 252. The PIC 252 is operable to determine the feed pressure P output from the gas production facility 110 and input to the input header 208 of the compressor system 200.

The feed pressure P may be measured as the suction pressure to the suction inlet of each reciprocating compressor. More particularly, suction pressure may be defined as the pressure at a suction filter inlet flange. A suction filter is operable to ensure dirt and debris from the gas production process does not enter the reciprocating compressors.

The controller 250 is operable to adjusting two manipulated variables in response to the measured suction pressure according to a split range control strategy.

Manipulated variables comprise parameters of the plant which can be controlled directly. In the present embodiment, the measured suction pressure is used by the controller to adjust the manipulated variables of the capacity control of the compressor system 200 and the recycle flow through valves 218.

The capacity control is operable to scale down the operational capacity of the compressor trains 202, 204, 206 accordingly when gas production from the facility 110 is lower due to lower power supply from the renewable sources 152, 154. Thus, the control strategy ramps down the compressors to save energy consumption. The capacity control strategy consists of a mixed capacity control scheme in a master/slave control architecture as described below.

Split-Range Control Strategy

The controller 250 utilises split range control to control the capacity of the compressor trains 202, 204, 206 and the recycle flow control. In other words, the controller generates output control signals to control the control respective valves and systems to achieve the stated aims.

Within a first range of the split range control above a predetermined threshold split value, then appropriate controls are modified to reduce the capacity of the compressor trains 202, 204, 206 in response to reduced suction pressure until the split value threshold is reached and the values of the split range enter a second range.

If the values are in the second range, then the recycle flow control valves are controlled to recycle gas from the discharge outlet(s) of the compressors to the suction inlet(s).

The threshold split level at which the change in control occurs can be set to any technical value. However, in the present embodiment, the split level is 30%. In other words, if the output value from the split-range block has a range between 100% and 30% then then capacity of the compressor trains 202, 204, 206 is modified in response to the measured suction pressure. This is in the manner described below.

Conversely, if the output value from the split-range block has a range between 30% and 0% then then recycle control valve(s) 218 are manipulated to recycle compressed air from the discharge outlet 214 to the suction inlet 212. In embodiments, the split range control 250 uses exclusive valve sequencing such that an "either-or" relationship exists. However, this need not be the case and other strategies may be used.

Capacity Control

Within the range of capacity control, the capacity control strategy will now be described. Capacity control may aim to maintain a predetermined pressure of gas from the discharge outlet under variable process conditions. Capacity in the context of compressors relates to the mass flow rate of gas that a compressor can support. The purpose of capacity regulation in reciprocal compressors in the present invention is primarily to save energy which is supplied from renewable sources. However, there are also operational benefits in adjusting the suction flow to match the gas process flow.

In embodiments, a master/slave architecture is utilised. In this control methodology, a first master subset of the compressor trains 202, 204, 206 is controlled differently from a second slave subset thereof. The first subset of the plurality of compressor trains 202, 204, 206 operates under continuous capacity control where the capacity of the respective compressor train 202, 204, 206 can be varied continuously in accordance with demand.

Conversely, the second subset of the plurality of compressor trains 202, 204, 206 is operated in a step-wise and substantially discontinuous manner. In embodiments, the continuous variation may be bounded between specific feed percentages. The train(s) under continuous control serve as the master control and the second subset as a slave control.

The number of compressor trains in the first subset may take any positive integer n provided that $n>1$ and $n<T$ where T is the total number of compressor trains 202, 204, 206 provided. The same criteria applies to the second subset. In other words, any number of compressor trains may be provided in either category provided there is at least one of each.

With regard to the first master subset, continuous (or stepless) capacity control may be achieved in numerous ways. In embodiments, the control system 250 is operable to control precisely one or more of the suction valve unloaders 216 of the compressor train(s) under continuous control.

As noted above, a suction valve unloader 216 is, in general, operable to act to prevent the closing of the suction inlet valve 212. Through precise control and adjustment, the suction valve unloader 216 can be modified to control the volume of gas that will be compressed in each compression cycle.

In each compression cycle, the suction valve closes ata specific time point determined by the controller 250. This reduces the intake of gas through the suction inlet, reducing the capacity of the particular compressor train(s).

In other words, a continuous capacity system is a precisely controlled and actuated suction valve unloader configuration. Control may be effected by means of hydraulic or electrical systems to precisely control and actuate the suction valve unloader 216 system.

In examples, the suction valve unloader may be controlled by a hydraulic actuator actuated by one or more solenoid valves. Sensors are also required; for example, a piston position sensor which may comprise a top dead centre sensor.

A continuous control system has significant advantages not least in terms of fast and continuous response time. The controller 250 is operable to control and coordinate all of the suction valve unloaders of the six cylinders of at least one selected compressor train 202, 204, 206, allowing precise part-loading of the compressor train(s) 202, 204, 206 and efficient operation thereof.

However, whilst continuous control has advantages in terms of efficiency and precision, such systems can be expensive and complex.

Concomitantly, at least one train of the plurality of compressor trains 202, 204, 206 falls within the second slave subset and is operated in a step-wise and substantially discontinuous manner. This may, in embodiments, be achieved through cylinder unloading and loading. The other train(s) therefore serve as slave controls to the master control based on continuous variation.

Cylinder loading and unloading in a step-wise fashion can also, in embodiments, be achieved through use of the suction valve unloader 216. A suction valve unloader 216 can take numerous forms for this purpose. In a basic form, the suction valve 212 is held open by the unloader and this allows the gas return to the suction during a compression stroke. In other words, suction valve unloaders are operable to bypass or at least hold open the suction inlet valve of a relevant cylinder, unloading one or both (in the case of double acting) ends of the cylinder. In such a case, unloading can be achieved at 50% or 0% (total unloading).

Commonly, unloaders may take the form of finger, plug and port unloaders.

Master/Slave Control Strategy

As described above, one or more compressor trains in the first master subset of trains operate under continuous control, whereas one or more compressor trains in the second slave subset operate under step-wise unloading of cylinders.

Consider the embodiment of FIG. 2. Three trains 202, 204, 206 are provided, with each train having three stages. One train 202 is within the first master subset and operates under continuous capacity control, and the remaining two trains 204, 206 fall within the second slave subset and are under step-wise unloading/loading control. In this scenario, there are six sets of cylinders per stage, and three stages per train. Therefore, there are 54 cylinders in total across the three trains providing capacity.

To avoid sudden shocks in load, and to ensure controllability, it is necessary to implement a control strategy for reduction of capacity using the defined approach. The strategy is shown schematically in FIGS. 4 and 5 and described as follows:

First, from 100% feed capacity, for a predefined initial range, the continuously variable train 202 is solely responsible for variation in capacity of the compressor system 200. In embodiments, the predefined initial range is 100%-90%. In other words, the first 10% of total capacity variation is solely achieved by continuous adjustment of the primary master control which is the capacity of train 202.

This initial range may alternatively be defined as an initial offset capacity assigned to the continuous control. It may, in embodiments, avoid possible loss of control in responding to cylinder unloading actions. Whilst in embodiments, 10% has shown effective benefits this value may take any suitable value and may, for example, be in the range of 5-30%.

It is further noted that the offset value of 10%, in embodiments, corresponds to the proportion of the total feed. However, in embodiments, the continuously variable train 202 only comprises a third of the total number of cylinders in the compressor system 200. Therefore, in order to achieve 10% total reduction in capacity across all the trains 202, 204, 206, in practice this means that each cylinder T1C1-T1C6 of each stage -1, -2, -3 of the train 202 has continuously reduced its capacity by up to 30%.

When the continuously variable train 202 is continuously unloaded, the suction valve unloaders 216 are configured to adjust the positions of the suction inlet valves 212 of each cylinder T1C1-T1C6 of each stage -1, -2, -3 of the train 202 simultaneously.

In other words, all suction valves 212 within all the stage of the train 202 are manipulated simultaneously. Therefore, in embodiments, the suction valve unloaders 216 and suction valves 212 of cylinders T1C1-T1C6 of each stage 202-1, 202-2, 202-3 are continuously adjusted to achieve the desired reduction in capacity. In embodiments, the reduction in capacity is identical across each stage 202-1, 202-2, 202-3.

Should the feed continue to decrease, then the control strategy implements step-wise unloading of at least one cylinder of one of the second slave subset including trains 204, 206. Given there are 54 cylinders in total across the compression system 200, one cylinder in each stage of a train (3 cylinders total in this embodiment) potentially handles 5.5% of the capacity of compression system 200 at full capacity.

Therefore, when the total input feed drops by a further 5.5%, the step-wise control is implemented to unload a first cylinder of each stage of the second slave subset trains 204, 206. When a further 5.5% drop in in input feed is determined, then a second cylinder of the second slave subset trains 204, 206 is unloaded.

In other words, action is taken to unload a cylinder when the feed drops by a percentage equivalent to the capacity supported by that cylinder under full capacity conditions.

The cylinders T2C1-T2C6 and T3C1-T3C6 are unloaded consecutively in a controlled order by the slave control to maintain a good balance of capacity between the trains 204, 206.

In embodiments, then cylinder T2C1 from each of the three stages of a first train 204 of the second slave subset is unloaded (3 cylinders total in this embodiment, one per stage of the train 204), followed by a cylinder T3C1 of each stage of a second train 206 of the second slave subset (3 cylinders total in this embodiment, one per stage of the train 206). Then, cylinder T2C2 of each stage of the first train 204 of the second slave subset is unloaded, followed by cylinder T3C2 of each stage and so on.

The unloading of the cylinders of the second slave subset of trains 204, 206 continues in this manner until only a single set of cylinders T2C1— T2C6 and T3C1— T3C6 in each stage of each train 204, 206 remain loaded (3 cylinders remain loaded per train in this scenario). In other words, the unloading of the cylinders of the trains 204, 206 continue in the sequence of T2C3, T3C3, T2C4, T3C4, T2C5 and T3C5 per stage until this condition is reached.

At this stage, with only a single set of cylinders T2C6 and T3C6 in each stage of each train 204, 206 remaining loaded, the continuous capacity control of the cylinders T1C1-T1C6 can be utilised to reduce the capacity to a predetermined minimum level of the continuous control. In embodiments, the minimum level is 30% (as a percentage of the capacity of the train 202 alone).

When the minimum level is reached, the split range control of controller 250 is operable to engage the local recycle control valve 218 of each train to recycle compressed air from the discharge outlet valve 214 of the respective final stage to the suction inlet valve 212 of each cylinder.

In summary, local recycle valves 218 may be used for capacity control when a) all but one set of cylinders in each second slave subset stage 204, 206 are unloaded and b) the compressor train 202 under continuous control in the first master subset reaches its minimum capacity.

In embodiments, the local recycle valves 218 are controlled simultaneously across the trains to achieve smooth operation and smooth transition from capacity control to recycle control.

Continuous Control Smoothing

As described above, the continuous control acts in the initial stage of a 10% drop in total feed capacity, and in the final drop in capacity when the last available step-wise cylinder has been unloaded.

In between these points, the continuous control acts to smooth the variation in load occurring as a result of the unloading of a cylinder. This is shown schematically in FIG. 5.

Figure 5:
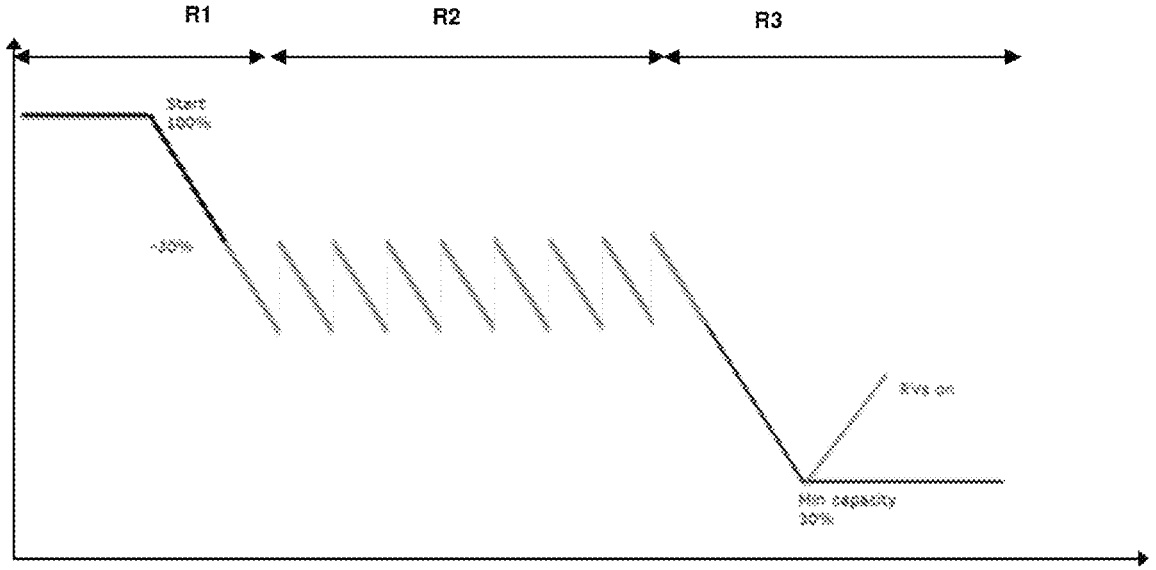
FIG. 5 is a schematic diagram illustrating the control process for a master train operation.

FIG. 5 shows the capacity of the train 202 (train 1) alone during a full operation from maximum to minimum capacity.

In the first region R1, the suction unload valves 216 of cylinders T1C1-T1C6 of each stage of the train 202 handle the initial drop of 10% of total (30% as a proportion of the reduced capacity of the train 202 having three stages each with six cylinders) smoothly and continuously. In other words, the suction unload valves 216 act to at least partially hold open the suction inlet valve 212 to reduce the effective capacity of the respective cylinder.

However, in a second region R2, the continuous control acts to smooth the sharp transitions in capacity from unloading individual cylinders of each stage of the second slave subset. As shown, the continuous control is operable to absorb all of the lost capacity for each unloaded cylinder T2C1-T2C6 of each stage of the second slave subset train for a temporary period. This is possible not least because by the stage when the first slave cylinder is unloaded, the continuous control will be operating at 70% capacity after the initial 10% of feed capacity is drawn off using continuous control only.

Figure 4:
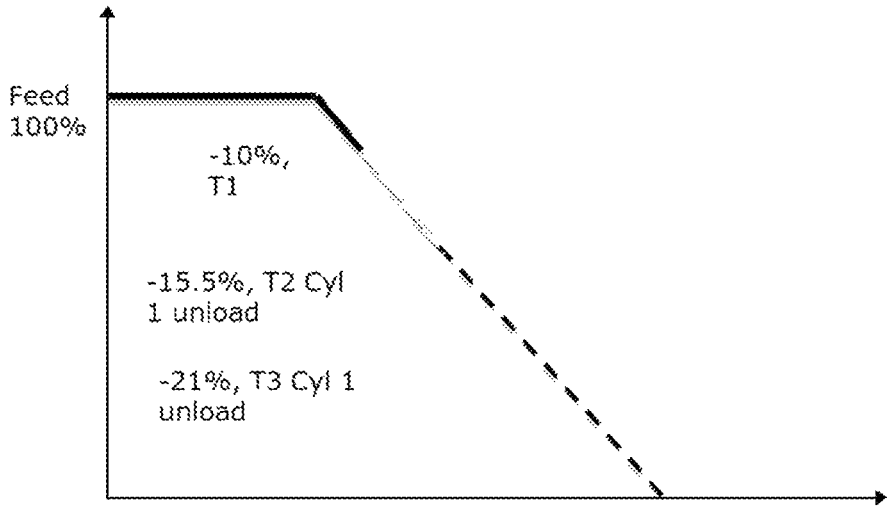
FIG. 4 is a schematic diagram illustrating part of the control process of the compression system of FIG. 2.

The next stage then corresponds to a further 16.5% drop in capacity of the continuous control (corresponding to the 5.5% drop across all cylinders discussed in FIG. 4).

At this point, as shown in FIG. 4, when a cylinder in each stage is unloaded, the continuous control acts to fill and smooth the missing capacity. This is then reduced as the total feed again reduces, before refilling to smooth the next cylinder unloading step. This continues until there are no further cylinders to be unloaded, in which case (in third region R3) the continuous control then continues to reduce capacity in train 202 until the minimum capacity is reached.

Scheduling with Different Cylinder Configurations

The above embodiments are described with reference to trains 202, 204, 206 having multiple stages where each stage comprises the same number of cylinders per stage. In practice such a configuration is beneficial in that during unloading (particularly for the slave trains under stepwise control) then the drop in capacity is the same for each series stage. This means that the pressures between stages (the interstage pressure) remains substantially constant.

However, there may be cylinder configurations where one or more stages of a train comprises a different number of cylinders from other stages. In such a configuration, unloading of one cylinder per stage will change the capacity of each stage by a different amount, potentially causing an imbalance and swing in the interstage pressures. This requires specific control and management to avoid potential operational problems.

Figure 6:
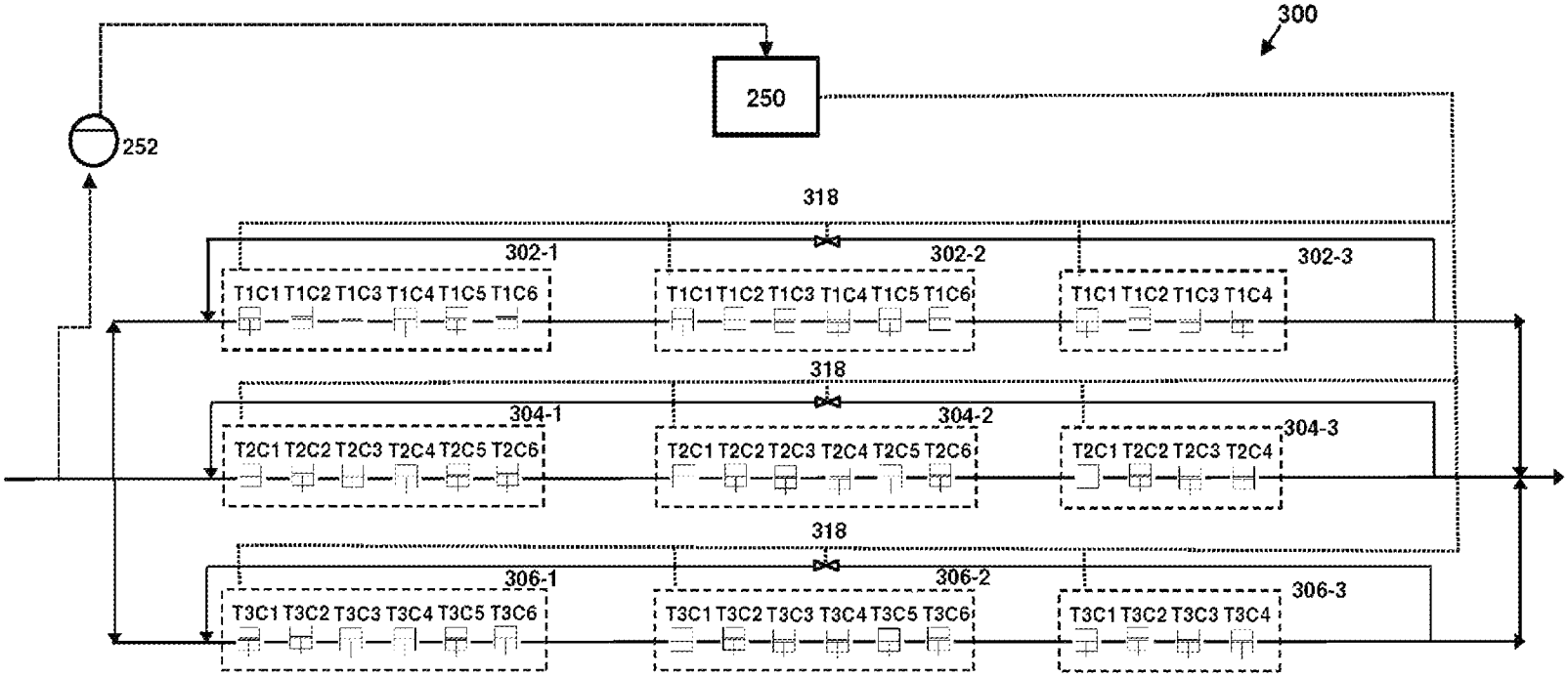
FIG. 6 is a schematic diagram of a compression system according to another embodiment.

An exemplary embodiment is shown in FIG. 6. In the embodiment of FIG. 6, a compression section 300 is provided which comprises three trains 302, 304, 306 and three stages 302-1, 302-2, 302-3, 304-1, 304-2, 304-3, 306-1, 306-2, 306-3. However, in contrast to the embodiments of FIGS. 2 and 3 in relation to compression section 200, the compression section 300 comprises three trains 302, 304, 306 with different numbers of cylinders per stage. Stages -1 and -2 of each train comprise six cylinders, whereas stage -3 of each train comprises four cylinders. Recycle valves 318 are provided.

Thus, there are five cylinders to unload for stages -1, -2 respectively and only 3 cylinders to unload in stage -3, on the basis that at least one set of cylinders (1 for each stage) must remain in operation when gas compression is taking place.

By way of assumption, the overall methodology will unload three cylinders (one in each stage) simultaneously across each train. Then, the final two cylinders of stages -1 and -2 will be unloaded until only one cylinder per stage remains loaded. Table 1 below shows the capacity reduction in stages -1 and -2 when compared to stage -3 when unloading one set of cylinders at a time simultaneously for the first three sets.

TABLE 1

| Cylinder set | Total capacity reduction in stages -1 and -2 | Total capacity reduction in stage -3 | Capacity imbalance between stages -1/-2 and stage -3 |
|---|---|---|---|
| 1 | 16.7% | 25% | 8.3% |
| 2 | 33.3% | 50% | 17.6% |
| 3 | 50% | 75% | 25% |

As shown, the capacity reduction imbalance between stages -1, -2 and stage -3 increases as more sets of cylinders are unloaded at the same time. The maximum difference in capacity reaches 25%. The inventors have found that the large difference in capacity reduction leads to significant swings in the interstage pressure between stages -2 and -3. As a result, the pressure profile or the pressure rise distribution between the stages deviates significantly from desired operational profile. This may result in operational problems.

In particular, simulations show that after unloading three sets of cylinders, a pressure rise at stage -2 exceeds the sum of the pressure rises in stages-2 and -3 at design. This can, in extreme cases, lead to stage -3 acting as a turbine rather than a compressor. This is extremely detrimental to the compressor and should be avoided.

As a result, in embodiments, a scheduling scheme of cylinder unloading is implemented to minimize the capacity reduction imbalance between each of the three stages.

The process aims to identify when to unload the cylinders in stage -3 together with stages -1 and -2. Since the first and second stages have more cylinders, these cylinders will be unloaded simultaneously during a stepwise transition. At the same time, it is determined whether a cylinder in stage -3 can be unloaded without creating a capacity imbalance. Table 2 below demonstrates the smart scheduling of unloading the cylinders stage -2 in a train.

TABLE 2

| Cylinder set | MP1&MP2 Cap. Down | Unloading MP3 | MP3 Cap. Down | Capacity Diff. |
|---|---|---|---|---|
| 1 | 16.7% | Yes ($1^{st}$) | 25% | 8.3% |
| 2 | 33.3% | No | 25% | −8.3% |
| 3 | 50% | Yes ($2^{nd}$) | 50% | 0 |
| 4 | 66.7% | Yes ($3^{rd}$) | 75% | 8.3% |
| 5 | 83.3% | No | 75% | −8.3% |

With reference to Table 2, when three cylinders are unloaded simultaneously corresponding to cylinder set 1, 3 and 4, and when only 2 cylinders in stages -1 and -2 corresponding to cylinder set 2 (all 3 cylinders in stage -3 are unloaded at set 5), the capacity reduction is maintained at the minimum.

Also note that the cylinder unloading scheme is for only a single train. However, this is equally applicable to additional trains. In addition, the same scheduling scheme applies to cylinder loading as well as unloading.

Integration with Gas Pressure Control

The above control system 250 has been described with reference to the control system for controlling the compressor system 200 or 300. However, additional integration with the gas production and storage system 100 will now be described.

Referring back to FIG. 1, the gas control system 352 is provided to control the flow of gas within the system 100. The gas control system 352 comprises gas production pressure control via pressure indicator controller (PIC).

The PIC 352 is operable to control valves 122*a* and 124*a* in order to regulate the pressure of gas in the discharge header 144 downstream of the production process and upstream of the downstream process unit 130.

The PIC 352 comprises a regulating split-range controller. The PIC 352 is operable to maintain a control (or process) variable at a constant set point by adjusting two manipulated variables according to a split range.

The manipulated variables comprise parameters of the plant which can be controlled directly. The control variables, in general, relate to process outputs from the plant which are not controllable directly but are dependent upon the values of the manipulated variables. In the present embodiment, the control variable is the pressure of gas P in the discharge header 144, and the manipulated variables correspond to the control valves 122*a*, 124*a*.

The PIC 352 utilises proportional-integral (PI) control of the control variable of the discharge header 144 pressure P. However, other methods, for example a proportional-integral-derivative (PID) controller may be used.

The PIC 352 is operable to maintain a constant pressure set point SP(P) for the pressure P (which is the process variable PV). In other words, the set point (SP) is a target value and the process variable (PV) is the measured value of the real-world parameter that my diverge from the desired set point. The error from the set point is the difference between the SP(P) and PV and is defined as set out in equation 1) below.

The value of the set point may be determined manually, automatically or empirically. In embodiments, the pressure P is set at a feed pressure for optimal operation of the downstream process unit 130. In order to achieve this, the PIC 352 utilises a PI control loop whereby the difference between the measured pressure P (variable PV(P)) and the desired set point pressure SP(P) is first determined in accordance with equation 1):

$$e(t)=SP(P)-PV(P) \quad 1)$$

Where e(t) is the error between the set point and the process variable as a function of time.

This value v is sent to the split-range block of the PIC 352 which splits value v into the two manipulated variables, i.e. generates output control signals to control the control valves 122*a*, 124*a*.

In order to achieve this, it is determined whether v is below or above the split value of the split-range controller. In embodiments, the split value is 50% although any other suitable value may be used.

If the output value from the split-range block has a range between 100% and 50% then then control valve 122*a* is manipulated. This may be in a continuous manner. Conversely, if the output value from the split-range block has a range between 50% and 0% then then control valve 124*a* is manipulated. In embodiments, the split range PIC 352 uses exclusive valve sequencing such that an "either-or" relationship exists between the valves 122*a*, 124*a* and gas flows through one valve or through the other, but never through both simultaneously.

In other words, when the PIC 352 output is between 50 and 100%, control valve 122*a* is progressively opened to enable gas flow to the gas storage resource 120. This situation may occur when the gas pressure P is above set point such that the gas production facility 110 is producing additional gas per unit time than is required by the downstream process unit 130, and as such the excess gas is surplus to requirements. In this scenario, the gas pressure P in the discharge header 144 is reduced by transferring excess gas to the gas storage resource 120 for later use.

Concomitantly, if the gas pressure P is lower than the set point SP(P), then the gas production facility 120 is unable to produce gas at the required rate (potentially due to lack of available renewable power) and stored gas from the gas storage resource 120 is required to supplement the produced gas in order to maintain the desired set point SP(P) pressure of gas P as feedstock for the downstream process unit 130. Consequently, if the PIC 352 output is between 50% and 0% then gas flows from the gas storage resource 120 to the inlet to the compressor section 114 to supplement the produced gas.

Gain Scheduling

A key aspect of effective split-range control is to ensure stable control of the processes whilst providing acceptable control performance. A PI controller such as may be implemented in the PIC 352 typically operates in a linear fashion. In other words, the control valves 122*a*, 124*a* will be controlled in a generally identical linear fashion with respect to the PIC 352 output. The valves 122*a*, 124*a* may be continuously variable between open and closed positions, or they may be variable in a step-wise fashion spatially and/or temporally (e.g. variation of open/close duty cycle).

Therefore, taking valve 122*a* as an example, this valve will open generally linearly from a closed position or fractionally open position at a PIC 352 output of 50% to fully open at a PIC 352 output of 100%.

However, complex gas production systems are often non-linear, or involve non-linear processes. As a result, controlling such systems in an equal and purely linear manner may cause system instability. This may be particularly acute when operating at the boundary of different operating modes (e.g. at an output around 50%, moving from a regime of gas feed to storage to a regime of gas being fed from storage).

One option to address this is to implement a "dead band" where a predetermined PIC 352 output range (e.g. 49 to 51%) does not result in any movement of the valves 122*a*, 124*a* to reduce instability.

An alternative or additional approach is to implement gain scheduling. Gain scheduling effectively implements one or more scaling factors $K_c$ for one or more values or ranges of values of the PIC 352 output. A higher value of $K_c$ means that a greater valve response is provided per unit change in PIC 352 output percentage. In other words, the value of Kc is a multiplication factor on the proportional error, and a higher value essentially causes the controller to be more aggressive when responding to errors away from the set point.

This scheduling may be asymmetrical and different values of $K_c$ implemented for different sides of the split range. In the present embodiment for example, it may be desired to implement a relatively large response per unit % when opening valve 122*a* to enable excess gas to be routed to storage, whereas it may be desired to implement a slower response when feeding gas from storage to the compression section 114.

A gain schedule requires a minimum of two sets of different parameters. However, any number of parameters may be implemented across any suitable number of ranges as required. A gain schedule may be stored in a memory of the PIC 352; for example in a suitable look-up table.

The above control approach is important when considering the variability of available renewable power. As the available supplied power is reduced, the gas production facility 110 will be required to ramp down accordingly and, as a result, the gas production throughput from the facility 110 will be reduce. Concomitantly, when the available supplied power increases, the facility 110 will be able to ramp up and, potentially, return to optimum production levels.

For certain gas facility types, for example electrolysers to produce Hydrogen gas which require significant power resources and have a relatively fast ramp rate, the production level of the gas facility 110 may substantially correspond to the available power level. However, for certain facility types, e.g. those with slower ramp rates, there may be a less direct relationship between available power and production levels.

Nevertheless, the use of control systems as outlined above in conjunction with gas storage are critical when operating under variable input power conditions such as in the case of renewable power supply and where a downstream process unit 130 may have a much slower ramp rate and so needs to be shielded from rapid changes in feedstock flow rate.

The above integration between compression system 200 and gas feed to and from storage 120 is a further key aspect to manage operation under variable power conditions.

EXAMPLE

Figure 7:
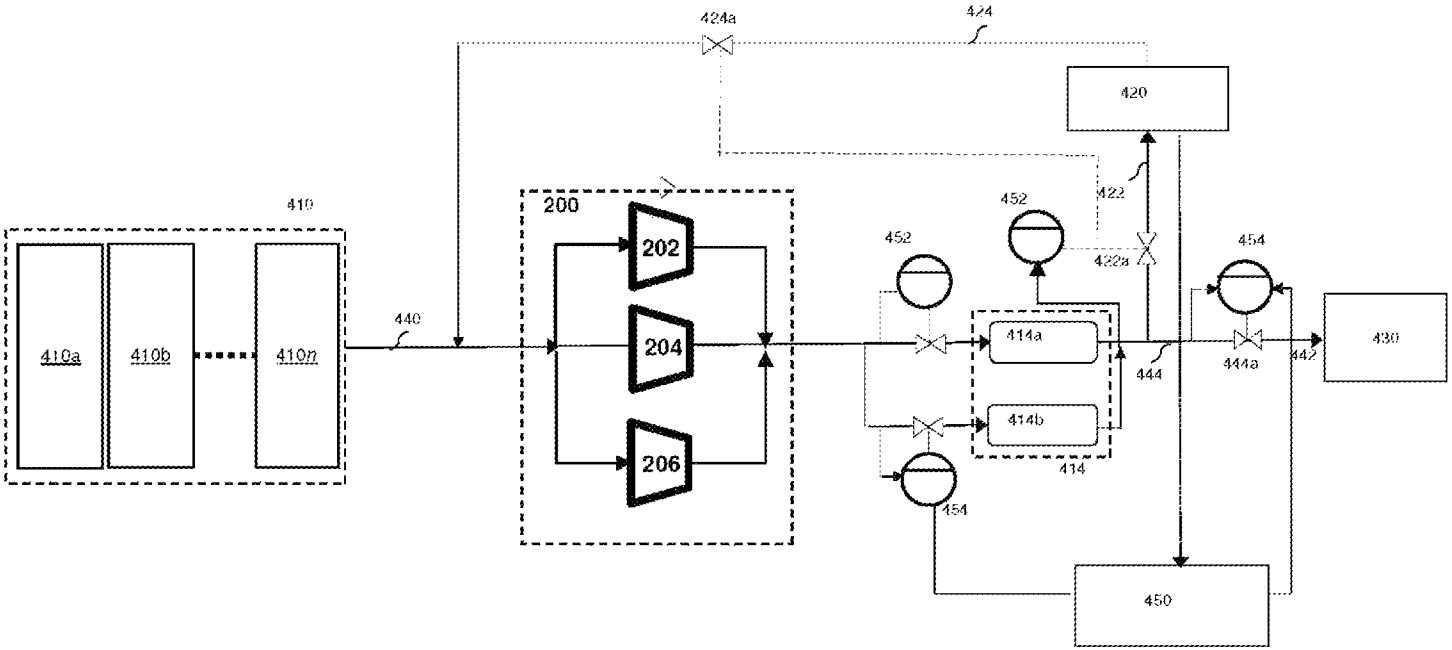
FIG. 7 is a schematic diagram of a production and storage facility for producing and supplying Hydrogen gas as a feedstock and suitable for utilising the compression system of FIGS. 1, 2, 3 and/or 6.

FIG. 7 shows another embodiment applied to a Hydrogen production plant and Hydrogen storage similar to that disclosed in, and suitable for use with, the embodiment of FIG. 1. Whilst compression section 200 is referenced in this embodiment, it is to be understood that compression section 300 may equally be utilized in this embodiment.

The production and storage system 400 comprises a Hydrogen production plant 410 and a Hydrogen gas storage resource 420. In common with the first embodiment, the Hydrogen production plant 410 is operable to electrolyse water to form Hydrogen and Oxygen.

A downstream process unit 430 is provided in the form of an Ammonia Synthesis plant 430 operating on the Haber-Bosch process and comprising an Ammonia Loop as described in relation to the first embodiment of FIG. 1 and the relevant details discussed therein also apply here.

A supply feed line 440 extends from an output header of the Hydrogen production plant 410 to a supply outlet 442 in fluid communication with the Ammonia Synthesis plant 430.

The Hydrogen production plant 410 comprises a plurality of electrolysis units 410*a*, 410*b* . . . 410*n* or electrolysis cells. Each unit or cell may be referred to as an "electrolyser" 410*a*, 410*b* . . . 410*n*. Any number of electrolysers may be provided. In embodiments, around 100 may be provided. Examples of suitable electrolysers and associated equipment are described in detail with respect to the embodiment of FIG. 1 and also apply here.

Hydrogen is produced at about atmospheric pressure by the Hydrogen production plant 410. A stream of Hydrogen so generated is removed from the electrolysers at a slightly elevated pressure. In embodiments, compression and purification sections 412, 414 are provided.

In embodiments, the compression system 200 corresponds to that as described in FIGS. 1 and 2 and controlled in the manner described in FIGS. 3 and 4. The final output pressure is selected as required for the downstream process(es).

The purification section 414 comprises a plurality of "DeOxo" units 414*a*, 414*b* in parallel, in each of which oxygen is removed by the catalytic combustion of Hydrogen to produce water and oxygen-depleted compressed Hydrogen gas, which may then be dried in a drier such as an adsorption unit, for example, a temperature swing adsorption (TSA) unit.

The gas storage resource 420 may comprise pressure vessels and/or pipe segments connected to a common inlet header and a common outlet header. The pressure vessels may be spheres, for example, to about 25 m in diameter, or "bullets" which are horizontal vessels with large L/D ratios (typically up to about 12:1) with diameters up to about 12 m. In certain geographies, underground caverns may be included as storage systems to flatten out the seasonal variations associated with the renewable power.

As for the second embodiment, the gas storage resource 420 is arranged in a parallel feed loop with the compression section 412 and purification section 414. An inlet feed line 422 extends from a discharge header 444 of the supply feed line 440 downstream of the compression and purification sections 200, 414 to the inlet header of the gas storage 420. A control valve 422*a* is located in the inlet feed line 422 to control flow of gas into the gas storage resource 420.

An outlet return feed line 424 extends from the outlet header of the gas storage resource 420 to the supply feed line 440 upstream of an inlet header of the compression section 412. Flow from the gas storage resource 220 is controlled by control valve 424*a* which selectively enables gas from storage to be fed back into the supply feed line 440 and into the compression section 412 and purification section 414 via return line 424.

A gas control system 450 is provided to control the flow of gas within the system 200. The gas control system 450 comprises two control levels—Hydrogen production pressure control via pressure indicator controller (PIC) 452 and production rate control for controlling Hydrogen feed flow to the downstream process unit 430 via flow indicator controller (FIC) 454.

As for the embodiment of FIG. 1, the PIC 452 is operable to control valves 422*a* and 424*a* in order to regulate the pressure of gas in the discharge header 444 downstream of the production process and upstream of the Ammonia production plant 430.

The PIC 452 comprises a regulating split-range controller and utilises proportional-integral (PI) control of the control variable of the supply feed line 440 pressure P downstream of the discharge header 444.

The PIC 452 is operable to maintain a constant pressure set point SP(P) for the pressure P of Hydrogen flowing to the Ammonia production plant 430. This may be determined manually, automatically or empirically. In embodiments, the pressure set point SP(P) is set at a feed pressure for optimal operation of the Ammonia production plant 430.

The PIC 452 utilises a PI control loop whereby the difference error between the measured pressure P and the desired set point pressure SP(P) for supply of Hydrogen to the Ammonia plant 430 is determined.

If the output value from the split-range block has a range between 100% and 50% then then control valve 422*a* is manipulated. Conversely, if the output value from the split-range block has a range between 50% and 0% then then control valve 424*a* is manipulated. In embodiments, the split range PIC 452 uses exclusive valve sequencing such that an "either-or" relationship exists between the valves 422*a*, 424*a* and gas flows through one valve or through the other, but never through both simultaneously.

In other words, when the PIC 452 output is between 50 and 100%, control valve 422*a* is progressively opened to enable Hydrogen gas flow to the Hydrogen gas storage resource 420. This situation may occur when the gas pressure P is above set point SP(P) such that the Hydrogen production plant 410 is producing more gas per unit time than is required by the Ammonia production plant 230, and as such the excess gas is surplus to requirements. In this scenario, the gas pressure P in the discharge header 444 of the supply feed line 240 is reduced by transferring excess gas to the gas storage resource 420 for storage and later use.

Concomitantly, if the Hydrogen gas pressure P is lower than the set point SP(P), then the Hydrogen production plant 410 is unable to produce gas at the required pressure (potentially due to lack of available renewable power) and stored Hydrogen gas from the gas storage resource 420 is required to supplement the produced gas in order to maintain the desired set point SP(P) pressure of gas P as feedstock for the Ammonia Production plant 430. Consequently, if the PIC 452 output is between 50% and 0% then gas flows from the gas storage resource 420 to the inlet to the compressor section 412 to supplement the produced gas.

In embodiments, at peak Hydrogen production, around 25% excess Hydrogen is produced which is then directed, using the split range controller, to the Hydrogen storage resource 420. When the renewable power is reduced, Hydrogen production is reduced and the PIC 452 will reduce the flow to Hydrogen storage 420. Eventually, the flow to the Hydrogen storage 420 will close and the flow from the storage 420 to the compression section 412 will start when the available power drops further. This control is accomplished automatically by the split-range PIC 454 which aims to keep the feed flow to the Ammonia plant 230 substantially constant.

Gain scheduling is an advantageous part of the control system. In this embodiment, the gain scheduling is implemented in two discrete regions:

$$\text{If output of } PIC\ 452 >= 50\%,\ Kc=2.5,\ \text{Else},\ Kc=0.5 \qquad 1)$$

where Kc is the gain of the PIC controller 452.

Flow control to the Ammonia plant 430 is also necessary. In this regard, the control system 450 implements production rate control for controlling feed flow to the Ammonia plant 430 via the flow indicator controller (FIC) 454.

The FIC 454 utilises a supervisory control system to control valve 444*a* in the feedstock header 444 providing gas to the Ammonia plant 430. The FIC 454 implements a proportional integral (PI) control system to control the control variable PV(F) corresponding to the flow rate F in the supply feed line 440 downstream of the discharge header 444.

In embodiments, the FIC 454 controls a feedstock flow rate F by setting a flow set point SP(F) at least in part in dependence upon the Hydrogen gas pressure in the storage resource 420 and/or the rate of change of Hydrogen gas pressure in the storage resource 420.

In embodiments, the FIC 454 controls the feedstock flow rate F in dependence upon the gas pressure of the gas storage resource 420. In other words, the target set point SP(F) of the FIC 430 for the flow to the ammonia plant can be set by the pressure levels in the Hydrogen storage. This may, in embodiments, be achieved by setting a new flow set point SP(F) by means of a look-up table or other implemented scheme with measured pressure values compared to predetermined threshold levels.

Table 3 below shows a simplified scheme for scheduling SF(F) values:

TABLE 3

| Index | P (bara) | Target SP(F) |
|---|---|---|
| 1 | 26 | SP(F0) |
| 2 | 21 | 85% SP(F0) |
| 3 | 16 | 70% SP(F0) |
| 4 | 11 | 50% SP(F0) |
| 5 | 7 | 25% SP(F0) |

Note that in Table 3 the standard operating pressure in the Hydrogen storage resource 420 at design conditions is 26 bara (26 bar absolute). However, this is not intended to be limiting and any suitable pressure values may be used depending upon the nature of the storage resource 420.

Further, the set point SP(F) of the FIC 454 for the flow control to Ammonia plant at design conditions is SF(F0). As the pressure in the Hydrogen storage resource 420 decreases, then the set point SP(F) is concomitantly reduced to a percentage of the design condition set point value SP(F0).

The above table illustrates pressure bands for the pressure of Hydrogen gas in the Hydrogen storage resource 420 at which specific set point flow rates SP(F) are implemented. For example, index 1 illustrates a band of pressures from >21 bara to 26 bar at which design flow rate SP(F0) is applicable.

It is further noted that the conditions and parameters illustrated above are illustrative and non-limiting. Other configurations or parameters may be used with the described embodiments.

When the pressure in the Hydrogen storage resource 420 drops from one index to another (e.g. index 1 to index 2), it is necessary to provide this change.

In summary, the disclosed embodiment is operable to 1) send excess produced Hydrogen to Hydrogen storage at high levels of available renewable power, and withdraws Hydrogen from the Hydrogen storage at low levels of available renewable power via a split-range control loop implementation as described above; and 2) regulate the feed to an Ammonia plant according to the Hydrogen storage inventory.

This approach ensures that 1) the production rate in Ammonia plant is regulated in a controlled manner with an acceptable, safe and robust rate of change; and 2) the Ammonia plant can continue to operate with acceptable feed flow without the risk of shutdowns due to depletion of Hydrogen from storage and the complete unloading of Hydrogen production from the electrolysers.

Finally, in the case of unloading of Hydrogen production from renewable power, the sequence in the control scheme includes:

1) Reduce the flow to Hydrogen storage at a rate in accordance to the rate of unloading of Hydrogen production from the electrolysers and stops the flow to storage when the unloading reaches certain level;
2) Once the flow to storage stops, Hydrogen is withdrawn from the storage to maintain a specific flow set point to the Ammonia plant;

When Hydrogen production from the electrolysers is sufficiently unloaded and Hydrogen inventory becomes low, the flow to the Ammonia plant can be reduced at the allowable rate (for example, at 3%/min) until depletion of the storage.

It is noted that 1) and 2) above are accomplished by a split-range controller. Further, due to the significant change in process dynamics, gain scheduling is embedded in the split-range controller.

Method

Figure 8:
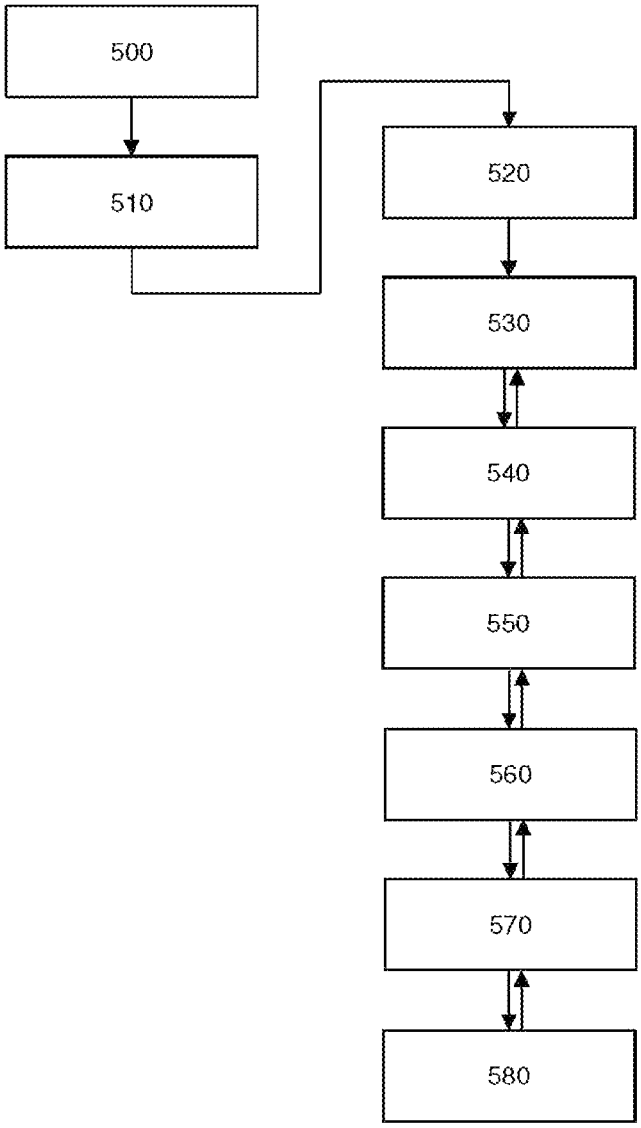
FIG. 8 is a flow diagram of a method according to an embodiment.

FIG. 8 shows a method according to an embodiment. In embodiments, there is provided a process for operating a compression system configured to compress a variable incoming gas feed, the compression system comprising a plurality of parallel compressor trains, each compressor train comprising one or more reciprocating compressor stages each having one or more cylinders.

At step 500, an incoming gas feed is received. The incoming gas feed is variable in that the flow rate, pressure and/or other physical parameters of the gas feed may vary as a function of time. The incoming gas feed may, in embodiments, be received from an industrial gas production plant. The incoming gas feed may also, in embodiments, be compressed to a pressure above production pressure by another compression system such as a low pressure (LP) compression system.

At step 510, the gas pressure of the incoming gas feed is determined and used in later steps to control the compression system in response thereto. Pressure may be determined through measurement or calculation based on other parameters. Alternatively or additionally, the flow rate of incoming gas may be determined. This may be done to determine capacity. Alternatively or additionally, throughput of gas may be used.

At step 520, the capacity of the compression system is controlled in response to the variable incoming gas feed by: i) selectively varying a capacity of a first subset of one or more of the compressor trains by continuously varying the capacity of one or more cylinders of the one or more reciprocating compressor stages of the one or more compressor trains of the first subset between a maximum capacity and a minimum capacity; and/or ii) selectively varying a capacity of a second subset of one or more of the compressor trains by fully loading or fully unloading one or more cylinders of the one or more reciprocating compressor stages of the compressor trains of the second subset. The first and second subsets are mutually exclusive.

By continuous variation is meant that the capacity can be varied in a stepless manner between any two desired levels, with a smooth transition between each. By fully loading and fully unloading is meant that the cylinders are loaded or unloaded in a single step-wise operation with a discrete transition between fully loaded and fully unloaded. Whilst the loading or unloading is for practical and engineering reasons not instantaneous and requires a short transition period between states, the transition can be treated as substantially discontinuous and step-wise.

The controlling of the compression system comprises various regimes of operation depending upon the relationship between the pressure, flow or other physical parameter of the incoming gas feed and the maximum capacity of the compression system. These regimes of operation are set out in the steps below. The steps are sequential below for a decreasing flow of incoming gas feed and represent operational behaviour in different regimes. The steps may be reversed for incoming gas flow which is increasing.

At step 530, during periods when the incoming gas feed is received by the compression system at a flow between a total maximum capacity of the plurality of compressor trains and a first threshold capacity lower than the total maximum capacity, the capacity of the first subset of one or more compressor trains is continuously varied in response to the change in flow of the incoming gas feed.

At step 540, during periods when the incoming gas feed is received by the compression system at a flow between the first threshold capacity of the plurality of compressor trains and a second threshold capacity lower than the first threshold capacity, the process comprises fully unloading one or more first loaded cylinders of the second subset of one or more compressor trains in response to the flow of the incoming gas feed reducing by an amount equal to the capacity of the one or more first cylinders, or fully loading one or more first unloaded cylinders of the second subset of one or more compressor trains in response to the flow of the incoming gas feed increasing by an amount equal to the capacity of the one or more first cylinders.

At step 550, and substantially simultaneous with step 540, in response to the full unloading of one or more first loaded cylinders of the second subset, the process comprises increasing the capacity of the first subset of one or more compressor trains by an amount equal to the capacity of the said one or more first cylinders or in response to the full loading of one or more first unloaded cylinders of the second subset, simultaneously decreasing the capacity of the first subset of one or more compressor trains by an amount equal to the capacity of the said one or more first cylinders.

At step 560, steps 540 and 550 may be repeated for one or more further cylinders of the second subset until only a single cylinder in each reciprocating compressor stage of each train of the second subset remains.

At step 570, during periods when the incoming gas feed is received by the compression system at a flow between the second threshold capacity and a total minimum capacity, the process comprises continuously varying the capacity of the first subset of one or more compressor trains in response to the change in flow of the incoming gas feed.

Each compressor train comprises a local recycle valve connected between an outlet from the compressor train and an inlet to the respective compressor train. At step 580, during when the incoming gas feed is received by the compression system at a flow which is at or below the total minimum capacity, the process comprises operating the local recycle valve of each compressor train to recycling gas from the outlet of each compressor train to the inlet of each compressor train.

Example Application of Ammonia Production Plant

Figure 9:
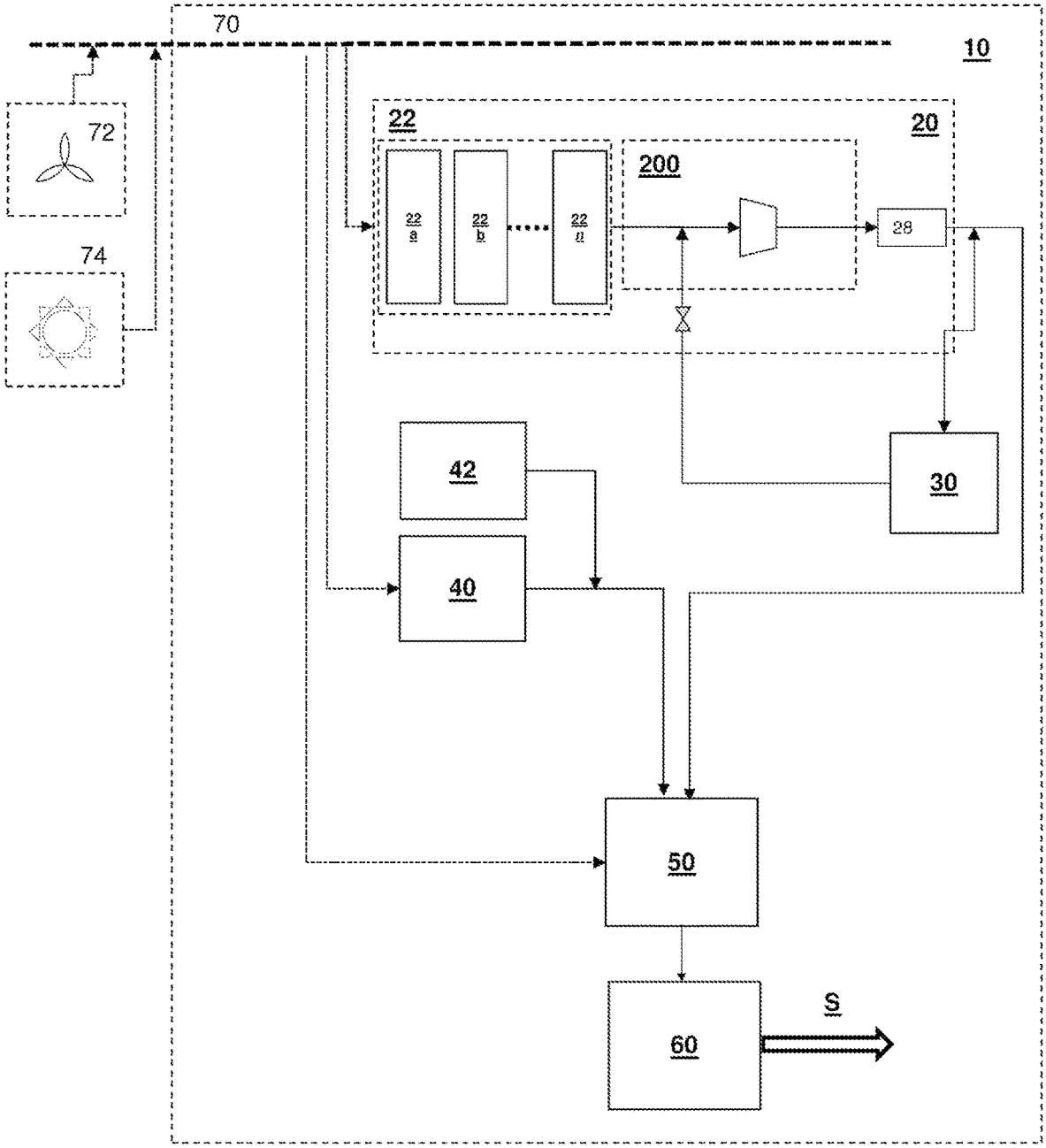

FIG. 9 shows a schematic diagram of an exemplary industrial gas plant complex 10 in the form of an Ammonia plant complex 10.

The Industrial gas plant complex 10 comprises a Hydrogen production plant 20, a Hydrogen storage unit 30, an Air Separation Unit (ASU) 40, an Ammonia synthesis plant 50 and an ammonia storage unit 60. The ammonia storage unit 60 is connected to an external supply chain S for onward distribution of Ammonia.

Any of the Hydrogen production plant 20, ASU 40 and Ammonia synthesis plant 50 may require gas compression. In this regard, the above embodiments of the invention may be applied to these applications.

Electricity for powering the Industrial gas plant complex 10 is provided by a main bus 70 supplied by a local power grid (not shown). Power for the industrial gas plant complex 10 is generated at least in part by renewable energy sources such as wind 72 (via a suitable wind farm comprising a plurality of wind turbines) and/or solar energy 74 (via a solar farm comprising a plurality of solar cells) although other sources such as a diesel-, petrol- or Hydrogen-powered generator (not shown) may optionally be utilised. Elements 72, 74 feed into the main bus 70 as shown by the arrows in FIG. 9.

Whilst the above examples of renewable power have been given with regard to wind and solar power, this is not intended to be limiting. For example, other renewable energy sources may be used such as hydro-electric (not shown) and/or tidal power (not shown).

The industrial gas production components of the Industrial gas plant complex 10 will now be described in detail.

Hydrogen Production Plant 20

The Hydrogen production plant 20 is operable to electrolyse water to form Hydrogen and Oxygen. Any suitable source of water may be used. However, in embodiments in which sea water is used to produce the water for the electrolysis, the apparatus would further comprise at least one desalination and demineralization plant for processing the sea water.

The Hydrogen production plant 20 comprises a plurality of electrolysis units 22*a*, 22*b* . . . 22*n* or electrolysis cells. Each unit or cell may be referred to as an "electrolyser" 22*a*, 22*b* . . . 22*n*. Any number of electrolysers may be provided. In embodiments, around 100 may be provided. The electrolysers may enable the Hydrogen production plant 20 to have a total capacity of at least 1 GW. In embodiments, the capacity may be in excess of 2 GW; for example, 2.2 GW. However, the ultimate capacity of the Hydrogen production plant 20 is limited only by practical considerations such as power supply.

Any suitable type of electrolyser may be used. In embodiments, the plurality of electrolysers usually consists of a multiplicity of individual cells combined into "modules" that also include process equipment such as pumps, coolers, and/or separators. Hundreds of cells may be used and may be grouped in separate buildings. Each module typically has a maximum capacity greater than 10 MW, although this is not intended to be limiting.

Any suitable type of electrolyser may be used with the present invention. Generally, three conventional types of electrolyser are utilized—alkaline electrolysers; PEM electrolysers; and solid oxide electrolysers. Any of these types may be used with the present invention.

Alkaline electrolysers transport hydroxide ions ($OH^-$) through the electrolyte from the cathode to the anode with Hydrogen being generated on the cathode side. Commonly, a liquid alkaline solution of sodium hydroxide or potassium hydroxide is used as the electrolyte.

A PEM electrolyser utilizes a solid plastics material as an electrolyte, and water reacts at an anode to form oxygen and positively charged Hydrogen ions. The electrons flow through an external circuit and the Hydrogen ions selectively move across the PEM to the cathode. At the cathode, Hydrogen ions combine with electrons from the external circuit to form Hydrogen gas.

Solid oxide electrolysers use a solid ceramic material as the electrolyte that selectively conducts negatively charged oxygen ions ($O^{2-}$) at elevated temperatures. Water at the cathode combines with electrons from the external circuit to form Hydrogen gas and negatively charged oxygen ions. The oxygen ions pass through the solid ceramic membrane and react at the anode to form oxygen gas and generate electrons for the external circuit.

The electrolysers may be arranged in any suitable group. For example, they may be arranged in parallel.

Hydrogen is produced at about atmospheric pressure by the Hydrogen production plant 20. A stream of Hydrogen so generated is removed from the electrolysers at a slightly elevated pressure.

In embodiments, the Hydrogen production plant 20 further comprises Hydrogen compression stage 200 and purification stage 28 as described below.

In embodiments, the compression stage 200 corresponds to that described above with reference to FIGS. 2, 3 and 6.

In the embodiment of FIG. 9, a purification section 28 is provided. The purification section 28 may be required where, for example, any downstream processes require higher purity Hydrogen (i.e. with reduced levels of water and/or oxygen inherently present in the compressed Hydrogen gas produced by the electrolysis). However, this need not be the case and this section may be omitted if not required.

If provided, the purification section 28 comprises a "DeOxo" unit operable to remove oxygen. The DeOxo unit operates through the catalytic combustion of Hydrogen to produce water compressed Hydrogen gas from which Oxygen has been removed.

The purification section 28 may further comprise a drier. In this embodiment, the drier comprises a temperature swing adsorption (TSA) unit to produce dry compressed Hydrogen gas for the downstream process(es). However, other suitable drier and/or adsorption technologies may be used here. In embodiments, the drier is downstream of the DeOxo unit.

A downstream processing unit may be any unit that utilises Hydrogen gas as a feedstock. In embodiments, the downstream processing unit is or includes an Ammonia synthesis plant. However, this need not be limiting.

Hydrogen Storage Unit 30

Any Hydrogen surplus to immediate requirements may be stored in the Hydrogen storage unit 30. The storage unit 30 may comprise any suitable a plurality of short-term and longer-term storage options with different sizes, filling/discharge rates, and roundtrip efficiencies.

Typical storage system could include pressure vessels and/or pipe segments connected to a common inlet/outlet header. The pressure vessels may be spheres, for example, to about 25 m in diameter, or "bullets" which are horizontal vessels with large UD ratios (typically up to about 12:1) with diameters up to about 12 m. In certain geographies, underground caverns may be included as storage systems to flatten out the seasonal variations associated with the renewable power.

In the context of the present embodiments, stored Hydrogen may be used as a reservoir for Ammonia Synthesis plant 50 to ensure sufficient supply. This will be discussed in further detail below.

Air Separation Unit 40

In non-limiting embodiments, the Nitrogen gas required for Ammonia production is produced by cryogenic distillation of air in the air separation unit (ASU) 40. Typically an ASU 40 has various stages operating at different pressures. For example, a high pressure (HP) Column operates at around 10.5 bar g and a low pressure (LP) Column operates at around 5 bar g. Gaseous Nitrogen is produced by the ASU 40 at pressures in excess of 25 bar g. The pressure is then reduced to provide a stream of Nitrogen gas in one or more pipes arranged to transport Nitrogen to the Ammonia Synthesis plant 40. However, other Nitrogen sources may be used if required, for example, Liquid Nitrogen storage 42.

Liquid Nitrogen storage unit 42 may comprise any suitable Liquid Nitrogen Storage, Vaporisation and Distribution (LIN SVD) arrangement. The storage unit 42 may comprise a plurality of short-term and longer-term storage options having different sizes, filling/discharge rates, and roundtrip efficiencies.

A typical storage system for Liquid Nitrogen may comprise a plurality of pressure vessels and/or pipe segments connected to a common inlet/outlet header. The pressure vessels may comprise low pressure flat bottom storage tanks (FBTs). Additionally or alternatively, the pressure vessels may be spheres, for example, to about 25 m in diameter, or "bullets" which are horizontal vessels with large L/D ratios (typically up to about 12:1) with diameters up to about 12 m.

Preferably, the Nitrogen gas produced by the ASU 40 is compressed by a compressor and cooled to be stored in the Nitrogen storage unit 40 in liquid form. However, gaseous Nitrogen storage may also be provided. The storage unit 40 may be used as a reservoir for Ammonia synthesis plant 50 which may be fed by a connecting pipe.

Ammonia Synthesis Plant 50

The Ammonia Synthesis plant 50 operates on the Haber-Bosch process and comprises an Ammonia Loop. An Ammonia Loop is a single unit equilibrium reactive system which processes the synthesis gases of Nitrogen and Hydrogen to produce Ammonia.

Nitrogen is provided by one or more pipes from the ASU 40 (or storage 42) which, in embodiments, may run continuously to provide Nitrogen. Hydrogen is provided from one or more pipes from Hydrogen production plant 20 either directly (if it is running based on the availability of the renewable power at given instance) or from the Hydrogen storage 30.

Stoichiometric composition of synthesis gas is processed by a syn-gas compressor system (not shown) and the resulting Ammonia product is refrigerated by another set of compressors (not shown) and sent to storage 60 if required. The performance of Ammonia loop is governed by the equilibrium conversion of the exothermic reaction. The parameters for this will be discussed below.

Whilst the compression system 200 has been described and illustrated in the context of the Hydrogen production plant 20, this need not be so. For example, the compression system 200 may be used to compress Nitrogen in the ASU 40, or Ammonia from the plant 50. Other suitable applications could be contemplated and will be described below.

While the invention has been described with reference to the preferred embodiments depicted in the figures, it will be appreciated that various modifications are possible within the spirit or scope of the invention as defined in the following claims.

For example, whilst the present embodiments have been described in relation to an Ammonia plant as a downstream end process, the present invention is applicable to any other suitable form of industrial gas plant utilising, at least in part, renewable power. For example, the industrial gas plant or gas complex may be a methanol production facility. Other alternatives will be apparent to one having ordinary skill in the art.

In the specification and claims, the term "industrial gas plant" is intended to refer to process plants which produce, or are involved in the production of industrial gases, commercial gases, medical gases, inorganic gases, organic gases, fuel gases and green fuel gases either in gaseous, liquified or compressed form.

For example, the term "industrial gas plant" may include process plants for the manufacture of gases such as those described in NACE class 20.11 and which includes, non-exhaustively: elemental gases; liquid or compressed air; refrigerant gases; mixed industrial gases; inert gases such as carbon dioxide; and isolating gases. Further, the term "industrial gas plant" may also include process plants for the manufacture of industrial gases in NACE class 20.15 such as Ammonia, process plants for the extraction and/or manufacture of methane, ethane, butane or propane (NACE classes 06.20 and 19.20), and manufacture of gaseous fuels as defined by NACE class 35.21. The above has been described with respect to the European NACE system but is intended to cover equivalent classes under the North American classifications SIC and NAICS. In addition, the above list is non-limiting and non-exhaustive.

In this specification, unless expressly otherwise indicated, the word "or" is used in the sense of an operator that returns a true value when either or both of the stated conditions are met, as opposed to the operator "exclusive or" which requires only that one of the conditions is met. The word "comprising" is used in the sense of "including" rather than to mean "consisting of".

In the discussion of embodiments of the present invention, the pressures given are absolute pressures unless otherwise stated.

All prior teachings above are hereby incorporated herein by reference. No acknowledgement of any prior published document herein should be taken to be an admission or representation that the teaching thereof was common general knowledge in Australia or elsewhere at the date thereof.

Where applicable, various embodiments provided by the present disclosure may be implemented using hardware, software, or combinations of hardware and software. Also, where applicable, the various hardware components and/or software components set forth herein may be combined into composite components comprising software, hardware, and/or both without departing from the spirit of the present disclosure. Where applicable, the various hardware components and/or software components set forth herein may be separated into sub-components comprising software, hardware, or both without departing from the scope of the present disclosure. In addition, where applicable, it is contemplated that software components may be implemented as hardware components and vice-versa.

Software, in accordance with the present disclosure, such as program code and/or data, may be stored on one or more computer readable mediums. It is also contemplated that software identified herein may be implemented using one or more general purpose or specific purpose computers and/or computer systems, networked and/or otherwise. Where applicable, the ordering of various steps described herein may be changed, combined into composite steps, and/or separated into sub-steps to provide features described herein.

While various operations have been described herein in terms of "sections", "facilities", "modules", "units" or "components," it is noted that that terms are not limited to single units or functions. Moreover, functionality attributed to some of the sections, facilities, modules or components described herein may be combined and attributed to fewer modules or components. Further still, while the present invention has been described with reference to specific examples, those examples are intended to be illustrative only, and are not intended to limit the invention. It will be apparent to those of ordinary skill in the art that changes, additions or deletions may be made to the disclosed embodiments without departing from the spirit and scope of the invention. For example, one or more portions of methods described above may be performed in a different order (or concurrently) and still achieve desirable results.

What is claimed is:

1. A process for operating a compression system configured to compress a variable incoming gas feed, the compression system comprising a plurality of parallel compressor trains, each compressor train comprising a plurality of reciprocating compressor stages connected in series, each reciprocating compressor stage having one or more cylinders, the process comprising:

controlling a capacity of the compression system in response to the variable incoming gas feed by:

i) selectively varying a capacity of a first subset of one or more of the compressor trains by continuously varying the capacity of one or more cylinders of each reciprocating compressor stages of the one or more compressor trains of the first subset between a maximum capacity and a minimum capacity; and ii) selectively varying a capacity of a second subset of one or more of the compressor trains by fully loading or fully unloading one or more cylinders of each reciprocating compressor stages of the compressor trains of the second subset;

wherein the first and second subsets are mutually exclusive, wherein the step of controlling the capacity of the compression system comprises: a) during periods when the incoming gas feed is received by the compression system at a flow between a total maximum capacity of the plurality of compressor trains and a first threshold capacity lower than the total maximum capacity, continuously varying the capacity of the first subset of one or more compressor trains in response to the change in flow of the incoming gas feed, and b) during periods when the incoming gas feed is received by the compression system at a flow between the first threshold capacity of the plurality of compressor trains and a second threshold capacity lower than the first threshold capacity, fully unloading one or more first loaded cylinders of the second subset of one or more compressor trains in response to the flow of the incoming gas feed reducing by an amount equal to the capacity of the one or more first cylinders, or fully loading one or more first unloaded cylinders of the second subset of one or more compressor trains in response to the flow of the incoming gas feed increasing by an amount equal to the capacity of the one or more first cylinders.

2. The process according to claim 1, wherein the capacity of the compression system is varied in response to the pressure of the incoming gas feed, and the process further comprises:

determining the gas pressure of the incoming gas feed.

3. The process according to claim 1, wherein varying the capacity of the first subset of the compressor trains comprises varying the capacity of each cylinder of each reciprocating compressor stage of the compressor trains forming the first subset simultaneously and by the same amount.

4. The process according to claim 1, wherein each of the one or more cylinders of the one or more reciprocating compressor stages of the one or more compressor trains of the first subset comprises a suction unloader valve to continuously vary the capacity thereof.

5. The process according to claim 1, wherein varying the capacity of the second subset of the compressor trains comprises fully loading or fully unloading one cylinder from each reciprocating compressor stage of the compressor trains of the second subset at a time.

6. The process according to claim 1, wherein each compressor train comprises the same number (n) of compressor stages, where n>1.

7. The process according to claim 1, wherein each reciprocating compressor stage comprises a plurality of cylinders.

8. The process according to claim 7, wherein each reciprocating compressor stage has the same number of cylinders.

9. The process according to claim 1, wherein step b) further comprises:

c) in response to the full unloading of one or more first loaded cylinders of the second subset, simultaneously increasing the capacity of the first subset of one or more compressor trains by an amount equal to the capacity of the said one or more first cylinders or in response to the full loading of one or more first unloaded cylinders of the second subset, simultaneously decreasing the capacity of the first subset of one or more compressor trains by an amount equal to the capacity of the said one or more first cylinders.

10. The process according to claim 1, further comprising repeating step b) for one or more further cylinders of the second subset.

11. The process according to claim 10, wherein step b) is repeated until only a single cylinder in each reciprocating compressor stage of each train of the second subset remains.

12. The process according to claim 1, wherein the step of controlling the capacity of the compression system further comprises:

d) during periods when the incoming gas feed is received by the compression system at a flow between the second threshold capacity and a total minimum capacity, continuously varying the capacity of the first subset of one or more compressor trains in response to the change in flow of the incoming gas feed.

13. The process according to claim 12, wherein each compressor train comprises a local recycle valve connected between an outlet from the compressor train and an inlet to the compressor train, and the step of controlling the capacity of the compression system further comprises:

e) during when the incoming gas feed is received by the compression system at a flow which is at or below the total minimum capacity, operating the local recycle valve of each compressor train to recycling gas from the outlet of each compressor train to the inlet of each compressor train.

14. A control system for operating a compression system configured to compress a variable incoming gas feed, the compression system comprising a plurality of parallel compressor trains, each compressor train comprising a plurality of reciprocating compressor stages connected in series, each reciprocating compressor stage having one or more cylinders, the control system being configured to control a capacity of the compression system in response to the variable incoming gas feed by:

i) selectively varying a capacity of a first subset of one or more of the compressor trains by continuously varying the capacity of one or more cylinders of each reciprocating compressor stages of the one or more compressor trains of the first subset between a maximum capacity and a minimum capacity; and ii) selectively varying a capacity of a second subset of one or more of the compressor trains by fully loading or fully unloading one or more cylinders of each reciprocating compressor stages of the compressor trains of the second subset;

wherein the first and second subsets are mutually exclusive, wherein the step of controlling the capacity of the compression system comprises: a) during periods when the incoming gas feed is received by the compression system at a flow between a total maximum capacity of the plurality of compressor trains and a first threshold capacity lower than the total maximum capacity, continuously varying the capacity of the first subset of one or more compressor trains in response to the change in flow of the incoming gas feed, and b) during periods when the incoming gas feed is received by the compression system at a flow between the first threshold capacity of the plurality of compressor trains and a second threshold capacity lower than the first threshold capacity, fully unloading one or more first loaded cylinders of the second subset of one or more compressor trains in response to the flow of the incoming gas feed reducing by an amount equal to the capacity of the one or more first cylinders, or fully loading one or more first unloaded cylinders of the second subset of one or more compressor trains in response to the flow of the incoming gas feed.

15. The control system according to claim 14, wherein varying the capacity of the first subset of the compressor trains comprises varying the capacity of each cylinder of each reciprocating compressor stage of the compressor trains forming the first subset simultaneously and by the same amount.

16. The control system according to claim 14, wherein each of the one or more cylinders of the one or more reciprocating compressor stages of the one or more compressor trains of the first subset comprises a suction unloader valve to continuously vary the capacity thereof.

17. The control system according to claim 14, wherein varying the capacity of the second subset of the compressor trains comprises fully loading or fully unloading one cylinder from each reciprocating compressor stage of the compressor trains of the second subset at a time.

18. A computer readable storage medium storing a program of instructions executable by a machine to perform a process for operating a compression system configured to compress a variable incoming gas feed, the compression system comprising a plurality of parallel compressor trains, each compressor train comprising a plurality of reciprocating compressor stages connected in series, each reciprocating compressor stage having one or more cylinders, the process comprising:

controlling a capacity of the compression system in response to the variable incoming gas feed by:

i) selectively varying a capacity of a first subset of one or more of the compressor trains by continuously varying the capacity of one or more cylinders of each reciprocating compressor stages of the one or more compressor trains of the first subset between a maximum capacity and a minimum capacity; and ii) selectively varying a capacity of a second subset of one or more of the compressor trains by fully loading or fully unloading one or more cylinders of each reciprocating compressor stages of the compressor trains of the second subset;

wherein the first and second subsets are mutually exclusive, wherein the step of controlling the capacity of the compression system comprises: a) during periods when the incoming gas feed is received by the compression system at a flow between a total maximum capacity of the plurality of compressor trains and a first threshold capacity lower than the total maximum capacity, continuously varying the capacity of the first subset of one or more compressor trains in response to the change in flow of the incoming gas feed, and b) during periods when the incoming gas feed is received by the compression system at a flow between the first threshold capacity of the plurality of compressor trains and a second threshold capacity lower than the first threshold capacity, fully unloading one or more first loaded cylinders of the second subset of one or more compressor trains in response to the flow of the incoming gas feed reducing by an amount equal to the capacity of the one or more first cylinders, or fully loading one or more first unloaded cylinders of the second subset of one or more compressor trains in response to the flow of the incoming gas feed.

* * * * *